US011607580B2

(12) United States Patent
Christy

(10) Patent No.: US 11,607,580 B2
(45) Date of Patent: Mar. 21, 2023

(54) VARRI, A VERTICAL RUNNING MACHINE, VERTICAL, ANTI-GRAVITY, REHABILITATION, RECOVERY, IMPACT RESISTANT

(71) Applicant: Jack D Christy, Indianapolis, IN (US)

(72) Inventor: Jack D Christy, Indianapolis, IN (US)

( * ) Notice: Subject to any disclaimer, the term of this patent is extended or adjusted under 35 U.S.C. 154(b) by 54 days.

(21) Appl. No.: 16/104,882

(22) Filed: Aug. 18, 2018

(65) Prior Publication Data

US 2019/0054342 A1 Feb. 21, 2019

Related U.S. Application Data

(60) Provisional application No. 62/547,285, filed on Aug. 18, 2017.

(51) Int. Cl.
*A63B 22/00* (2006.01)
*A63B 21/00* (2006.01)
(Continued)

(52) U.S. Cl.
CPC ..... *A63B 22/0025* (2015.10); *A61H 1/0229* (2013.01); *A61H 1/0244* (2013.01);
(Continued)

(58) Field of Classification Search
CPC . A63B 21/00; A63B 22/0025; A63B 22/0046; A63B 23/00; A63B 24/00;
(Continued)

(56) References Cited

U.S. PATENT DOCUMENTS 1,144,085 A * 6/1915 Abplanalp ..... A63B 21/154 482/95
4,511,137 A * 4/1985 Jones ..... A63B 21/00181 482/100

(Continued)

OTHER PUBLICATIONS

Patil, S., Steklov, N., Bugbee, W.D., Goldberg, T., Colwell, C.W., Jr. and D'Lima, D.D. (2013), Anti-gravity treadmills are effective in reducing knee forces. J. Orthop. Res., 31: 672-679. https://doi.org/10.1002/jor.22272 (Year: 2013).*

*Primary Examiner* — Justine R Yu
*Assistant Examiner* — Kelsey E Baller
(74) *Attorney, Agent, or Firm* — Ritchison Law Offices, PC; John D Ritchison

(57) ABSTRACT

A Vertical Running Machine called a VARRI—Vertical, Anti-Gravity, Re-habilitation, Recovery, and Impact Resistant. It relates to the field of bio-mechanical technology, human physiological facts, and the relationship of gravity and the functionality of the body in motion. This is a Vertical, Anti-gravity device created for Recovery from injuries, physical therapy Rehabilitation with the functional characteristics of Impact-free conditioning and by providing a non-impact system to improve the conditioning or recovery of the user, the patient or the elderly. The device provides a method of a more rapid and safer recovery from injuries and surgery and also is capable to provide enhanced athletic performance by using a vertical, non-impact system which alleviates the damages on the muscles and skeletal structure of the body from the continuous impact of horizontal running on the ground.

9 Claims, 12 Drawing Sheets

(51) Int. Cl.

| | |
|---|---|
| ***A61H 1/02*** | (2006.01) |
| ***A63B 69/00*** | (2006.01) |
| ***A63B 24/00*** | (2006.01) |
| ***A63B 71/06*** | (2006.01) |
| ***A63B 21/062*** | (2006.01) |

(52) U.S. Cl.

CPC ..... *A61H 1/0262* (2013.01); *A63B 21/00181* (2013.01); *A63B 21/063* (2015.10); *A63B 21/154* (2013.01); *A63B 21/158* (2013.01); *A63B 21/4009* (2015.10); *A63B 21/4015* (2015.10); *A63B 21/4029* (2015.10); *A63B 21/4034* (2015.10); *A63B 22/0046* (2013.01); *A63B 24/0087* (2013.01); *A63B 69/0028* (2013.01); *A63B 71/0619* (2013.01); *A61H 2201/0149* (2013.01); *A61H 2201/0173* (2013.01); *A61H 2201/0192* (2013.01); *A61H 2201/1207* (2013.01); *A61H 2201/1261* (2013.01); *A61H 2201/14* (2013.01); *A61H 2201/1409* (2013.01); *A61H 2201/1642* (2013.01); *A61H 2201/1652* (2013.01); *A61H 2201/1657* (2013.01); *A61H 2201/5007* (2013.01); *A61H 2201/5023* (2013.01); *A61H 2203/04* (2013.01); *A61H 2203/0431* (2013.01); *A61H 2203/0456* (2013.01); *A63B 2022/0094* (2013.01); *A63B 2208/0233* (2013.01); *A63B 2208/0252* (2013.01); *A63B 2208/12* (2013.01); *A63B 2225/09* (2013.01)

(58) Field of Classification Search

CPC ..... A63B 24/0003; A63B 24/0062; A63B 24/0087; A63B 71/0619; A63B 69/0028; A63B 21/154; A63B 21/156; A63B 21/4011–4015; A63B 23/04; A63B 23/0405; A63B 23/0476; A61H 1/0229; A61H 1/0262; A61H 1/0244; A61H 1/02; A61H 1/0237; A61H 1/024; A61H 1/0255; A61H 2201/0192; A61H 2201/1657; A61H 2201/5007; A61H 2201/0149; A61H 2201/1409; A61H 2201/5023; A61H 2201/1207; A61H 2201/1652; A61H 2201/1261; A61H 2201/0173; A61H 2203/04; A61H 2203/0431; A61H 2203/0456

USPC ..... 601/23–24, 26–27, 29; 482/1–9, 51–52, 482/54, 57, 66, 69

See application file for complete search history.

(56) References Cited

U.S. PATENT DOCUMENTS

| | | | | | |
|---|---|---|---|---|---|
| 4,746,113 | A * | 5/1988 | Kissel | A63B 21/0628 | 482/5 |
| 5,181,895 | A * | 1/1993 | Larson | A63B 21/154 | 482/148 |
| 5,207,621 | A * | 5/1993 | Koch | A63B 22/0056 | 482/112 |
| 5,261,865 | A * | 11/1993 | Trainor | A63B 23/03575 | 482/904 |
| 5,480,375 | A * | 1/1996 | La Fosse | A61H 1/0229 | 601/23 |
| 5,820,519 | A * | 10/1998 | Slenker | A63B 21/015 | 482/4 |
| 6,152,855 | A * | 11/2000 | Dean, Jr. | A61H 1/0259 | 482/114 |
| 6,592,502 | B1 * | 7/2003 | Phillips | A61H 1/0214 | 482/121 |
| 6,666,801 | B1 | 12/2003 | Michalow | | |
| 7,137,959 | B2 * | 11/2006 | Phillips | A61H 1/0237 | 601/5 |
| 7,357,768 | B2 | 5/2008 | Marshall | | |
| 8,572,774 | B1 * | 11/2013 | Osika | A61H 1/0255 | 5/83.1 |
| 2002/0094919 | A1 | 7/2002 | Rennox et al. | | |
| 2003/0115031 | A1 | 6/2003 | Bezah et al. | | |
| 2005/0010145 | A1 * | 1/2005 | Fenkell | A61H 1/0218 | 601/99 |
| 2006/0046909 | A1 | 3/2006 | Rastegar et al. | | |
| 2008/0113853 | A1 * | 5/2008 | Jang | A61H 1/0292 | 482/142 |
| 2010/0210978 | A1 * | 8/2010 | Oddsson | A61H 1/0229 | 601/24 |
| 2011/0177916 | A1 * | 7/2011 | Rainey | A63B 21/4029 | 482/8 |
| 2011/0195819 | A1 * | 8/2011 | Shaw | A63B 22/0005 | 482/5 |
| 2014/0038777 | A1 * | 2/2014 | Bird | A63B 21/151 | 482/5 |
| 2014/0100491 | A1 | 4/2014 | Hu et al. | | |
| 2014/0228720 | A1 | 8/2014 | Kim et al. | | |
| 2015/0182408 | A1 | 7/2015 | Roh et al. | | |
| 2016/0158086 | A1 * | 6/2016 | Schmitt | A61H 1/0255 | 601/27 |

* cited by examiner 41C
41B
41A
41

STANDARD/ I BEAM
PIPE/ROUND TUBING
WIDE FLANGE BEAM
SQUARE/RECT. TUBING
CHANNEL
TEE BAR

Fw
Fboot
Fhw 1
2
3
4
5
6
30
42
43
44
45
46
47
48
49
50
51
52
53
54
55
60
62
64
66
70
75
76
77
78
79
80
81
82
83
100

92

| | Running | | | | | |
|---|---|---|---|---|---|---|
| | Muscle | Peak Force (N) | | Joint | Peak Force (N) | |
| M | Soleus | 2880 | | Hip on Femur (Y) | 111,000 | Ay |
| N | Gluteus Medius | 1152 | | Knee on Tibia (Y) | 100,000 | By |
| O | Medial Gast | 1395 | | Ankle on Talus (Y) | 4000 | Cy |
| P | Rectus Femoris | 966 | | Hip on Femur (X) | 80000 | Ax |
| Q | Gluteus Max 2 | 723 | | Knee on Tibia (X) | 65000 | Bx |
| R | Ant Tibialis | 584 | | Ankle on Talus (X | 5900 | Cx |
| S | Biceps Fem sh | 548 | | Hip on Femur (Z) | 20,000 | Az |
| T | Biceps Fem lh | 540 | | Knee on Tibia (Z) | 10,000 | Bz |
| U | Glut Max 1 | 475 | | Ankle on Talus (Z) | 1800 | Cz |
| V | Lateral Gast | 488 | | | | |
| W | Glut Max 3 | 461 | | | | |
| | | | | | | |
| | | | | | | |
| | | | | | | |
| | | | | | | |
| | Device with 10 lbs on each foot | | | | | |
| | Muscle | Peak Force (N) | | Joint | Peak Force (N) | |
| M | Soleus | 453 | | Hip on Femur (Y) | 800 | Ay |
| N | Gluteus Medius | 462 | | Knee on Tibia (Y) | 330 | By |
| O | Medial Gast | 1135 | | Ankle on Talus (Y) | 320 | Cy |
| P | Rectus Femoris | 905 | | Hip on Femur (X) | 2200 | Ax |
| Q | Gluteus Max 2 | 142 | | Knee on Tibia (X) | 1200 | Bx |
| R | Ant Tibialis | 235 | | Ankle on Talus (X | 3700 | Cx |
| S | Biceps Fem sh | 516 | | Hip on Femur (Z) | 500 | Az |
| T | Biceps Fem lh | 547 | | Knee on Tibia (Z) | 120 | Bz |
| U | Glut Max 1 | 55 | | Ankle on Talus (Z) | 150 | Cz |
| V | Lateral Gast | 238 | | | | |
| W | Glut Max 3 | 89 | | | | |

93

Fig. 10

VARRI, A VERTICAL RUNNING MACHINE, VERTICAL, ANTI-GRAVITY, REHABILITATION, RECOVERY, IMPACT RESISTANT

CROSS-REFERENCE TO RELATED APPLICATIONS

This application claims the benefit of United States Provisional patent application with Ser. No. 62/547,285 filed Aug. 18, 2017, by Jack D. Christy and entitled "The VARRI—A Vertical Running Machine—Vertical, Anti-Gravity, Rehabilitation, Recovery, Impact Resistant".

FIELD OF INVENTION

This bio-mechanical technology relates to the relationship of gravity and the functionality of the body in motion. This invention relates to the field of the biomechanics of running without repetitive impact or deviation cause by gravitational forces which can compromise affiliated body parts. The device relates to an anti-gravity running device that provides a non-impact rehabilitation and training system which eliminates the gravitational impact on the body's joints and bones. The present technology relates to the relationship of gravity and the functionality of the body in motion utilizing bio-mechanical technology. Finally, the invention relates to a simulation system and method with a computer-readable medium for synthesis and analysis of human motion under partial assist from powered exercise devices.

FEDERALLY SPONSORED RESEARCH

None.

SEQUENCE LISTING OR PROGRAM

None.

BACKGROUND

Field of Invention and Prior Art

As far as known, there are no Vertical Running Machine like the one presented herein. It is believed that this product/system is unique in its design and technologies.

People face problems when they have physical restrictions from a debilitating ailment, age, or are rehabilitating from an accident or illness. Short or long term restrictions prevents them from simple walking or running which is characterized as an impact on their joints. This restriction occurs when they attempt to walk or exercise even with the help of a walker or cane. In short, a lot of these people cannot walk or run at all. Such a condition often prevents them from getting the exercise their legs need to prevent further disease or deterioration of the joints. The same condition prevents rehabilitation, improvement and/or return to some state of normalcy with their muscle and skeletal condition. Biomechanical analysis has shown that the most important muscles causing forward progress of the body in running are the hip flexors and hip extensors. Numerous hip strengthening devices have been developed. These hip training devices may be separated into those that are: 1) stationery apparatuses, where the athlete stands or lies in one place and moves the hip against a resistance mechanism, i.e. cable-pulley mechanism with associated weight stack and 2) mobile, where weight is attached to the lower extremity, thereby allowing resistance training of those muscles while the athlete is actually performing a sporting activity such as running. Since about 1970 a multitude of exercise machines have been developed with a wide variety of resistance mechanisms, including isotonic, isokinetic, pneumatic, hydraulic resistance and elastic resistance mechanisms. These machines typically are adapted to train one aspect of performance, such as acceleration or stretch-shortening.

The biomechanics of running involves the stabilization, propulsion, and the breaking of the body's center of gravity as a result of reaction forces between the bottom of the feet and the contact with the ground surface. The muscle activity during exercise includes the hamstrings, hip extenders, rectus femora's, quadriceps, gastrocnemius and the anterior tibia. This is in a field of technology that applies directly with the problems that exists with normal running such as the bodily damages that exists on the joints and bones which experience internal point loads as the body's mass reactions of the forces from impact with the ground surface. The loading leads to joint and bone damage after repetitive impact causing the body's center of mass to become unstable while running. This repetitive impact permits damage to also occur in the ligaments, tendons and cartilage due to excess stress greater and exceeds what than the tissue can handle. This repetitive impact is the result of the body's weight accelerating towards the ground which is caused by the gravitational forces effect on the body.

Problem Solved

The new technology in this invention provides a novel solution by alleviating the loads on the joints and the removing the gravitational effect on the body while maintaining the same exercising loads on the muscles experienced during running. The VARRI device also helps to train the muscle fibers of the body outside the detrimental effects of gravity and repetitive impact during rehabilitation. The prior art fails to teach a device such as VARRI which has adequate joint isolation adapted to train for stretch-shortening, acceleration, or both.

Prior Art

A novelty search reveal no prior art like the VARRI-Vertical Running Machine. The search revealed:

A. U.S. Pat. No. 4,928,859 by Bassett et al. in 1990 for Method and device for providing active exercise treatment for a patient suffering from a bone disorder. A patient strikes a sensor in a manner to produce an impact load at an impact rate along the axis of a bone experiencing the bone disorder, and that impact load and impact rate are measured and compared to desired impact load.

B. U.S. Pat. No. 6,666,801 by Michalow in 2003 for Sports specific training method and apparatus—A method and apparatus that provides resistance to train for acceleration and the stretch-shortening cycle through a range of motion that simulates a particular sport or motion of a particular sport or activity such as running. The joint is isolated using a three contact point stabilization system then exercised accordingly.

C. U.S. Pat. No. 7,357,768 by Marshall in 2008 for Recliner exerciser—A recliner exerciser for simulating walking in which the user can adjust the degree on reclining as well as the amount of simulated walking and exercise his or her legs are subjected. A motorized gear box operates two moveable foot rests in varying degrees of incline to provide minor to aggressive walking simulation for the user.

D. U.S. Patent Application 2002/0094919 by Rennex et al., in 2002 for an Energy-efficient running aid. This relates to passive (spring-actuated) running/walking aids for ortheses, prostheses, and robots—to allow faster running using less energy. The full invention is a leg ortheses or an energy-efficient running brace. It is a running brace which acts in parallel with a runner's leg to support the runner during stance phase and to capture all foot-impact energy, preferably with the optimal constant-force curve, for use to thrust said runner back into the air during toe-off.

E. U.S. Patent Application 2003/0115031 by Bezah et al. in 2003 is a Simulation system, method and computer-readable medium for human augmentation devices. A system, a method and a computer readable medium are provided for simulating a combined musculoskeletal and augmentation device system. The dynamics model of the combined musculoskeletal and augmentation device system receives computed torques at the joints as inputs and delivers simulated kinematic data of the segments as outputs. The augmentation device controller for control of the augmentation device, receives the simulated kinematic data as inputs and delivers assist torques as outputs.

F. U.S. Patent Application 2006/0046909 by Rastegar et al., in 2006 is for Walk-assist devices and methods. A method for reducing an exerted energy associated with muscles acting across a joint is provided. The method including: storing energy during one or more periods of a periodic motion of the joint in which energy is absorbed by the muscles; and at least partially returning the stored energy to the muscles during one or more periods of the periodic motion in which the muscles are performing work.

G. U.S. Patent Application 2014/0100491 by Hu et al., in 2014 for a Lower Extremity Robotic Rehabilitation System. It is to achieve "ecological" robotic rehabilitation therapy, the present invention provides the system capacity of training of patients in different ambulatory tasks utilizing motorized footplates that guide the lower limbs according to human gait trajectories generated for different ambulatory tasks of interest. A lower extremity robotic rehabilitation system comprises an active pelvic/hip device which applies series elastic actuation to achieve an intrinsically safe and desirable impedance control. A robotic unit features the telepresence operation control that allows a patient stay at home or nursing home to continue his or her rehabilitation training under a physician's remote supervision and monitoring.

H. U.S. Patent Application 2014/0228720 by Kim et al., in 2014 is for a Pelvis Support Device for Gait Rehabilitation Robot. The pelvis support device according to an embodiment of the present disclosure is used for a gait rehabilitation robot having a gait assistance link member connected to the leg of a rehabilitator and includes a support frame, one pair of support bars linearly movable along the longitudinal direction of the support frame, a first driving unit for transmitting power so that the support bar moves along the longitudinal direction of the support frame, a ball screw disposed in each support bar, a movable block coupled to the ball screw and linearly movable along the longitudinal direction of the support bar according to the operation of the ball screw, and a second driving unit for transmitting power to drive the ball screw.

I. U.S. Patent Application 2015/0182408 by Roh et al., in 2015 is for a Motion Assistive Apparatus and Method for Controlling the Same. A motion assistive apparatus may include a receiver allowing a user to intuitively adjust performance of the motion assistive apparatus and a method of controlling the same. The motion assistive apparatus may include a receiver provided to adjust variable characteristics of the motion assistive apparatus, a processor to adjust a variable parameter related to adjustment of the variable characteristics, in response to adjustment of the variable characteristics through the receiver, and an actuator to output changed assist power in response to adjustment of the variable parameter to change the variable characteristics.

None of the devices and systems use the same or similar configuration and features as shown with the VARRI. They all fail to remove the effects of gravity on rehabilitation and impact. None anticipate nor render obvious the method and device Christy employs to monitor and improve the user's reaction at the muscle and skeletal reference points to achieve specific exercise and rehabilitation without impact forces and gravitational pulls during the exercise.

SUMMARY OF THE INVENTION

This novel technology is called the VARRI—A Vertical Running Machine—is an acronym for Vertical, Anti-Gravity, Rehabilitation, Recovery, Impact Resistant. This is a uniquely defined bio-mechanical device. It provides a means to assist the human body, at virtually all ages and physical condition, to maintain healthy muscle structure. This is done by providing a non-impact means and method of accelerated rehabilitation/recovery from injury and providing a faster recovery from surgical procedures. In addition it assists in improving the motor skills and joint functions of the elderly without limiting their natural responses. The VARRI affects the three types of muscle groups, the skeletal, the cardiac, and the smooth involuntary muscle groups by programming it (the VARRI) to prescribe the exact kinetic exercise protocol for rehabilitation, maintenance and the enhancement of the exercise targeted specifically applicable to each muscle group.

Another object of the Vertical Running Machine technology is that it has the means and the capability of neutralizing the gravitational load based on the fact that running is a horizontal transfer of body interactions with gravity forces which are eliminated by the function of this technology. By neutralizing gravity during the simulated running, in order to move the body from the support phase to flight phase of running, the body is not having to overcome gravity. This allows the body to develop greater strength in the quads, calves and hamstrings (which are specifically known as the anti-gravitational muscles) which in turn strengthens the core muscles through the specific mechanical programming while the user is in the anti-gravity position on the apparatus. By using the proper training guidelines of this invention, it is possible to elongate the quadriceps and the hamstrings within the anatomy of the upper leg, thereby producing even greater flexibility and a more spontaneous response upon command without impact.

Another feature exemplified in this unique device is that it builds a new concept into the training techniques by increasing the users stride length and stride frequency. By removing the gravitational factor and establishing a controlled rhythmic pattern throughout a series of adjustable guide rods and pulleys, the flexibility of the stride length and the cadence of the stride frequency is directly developed which relates to the extension/contraction principle and which in turn develops a constant repetitive motion. With proper training within the scope of this invention it is possible to alter the genetic pathway of the relationship of the normal 50/50 fast vs slow twitch fibers into a 80/20 fast to slow twitch ratio.

A further object of this invention pertains to the versatility of training for the specific type of running desired by the athlete such as sprinting, middle distance, or long distance, which is accomplished by varying the resistance, the number of sets and repetitions, the time between sets and the pace at which the stride is done. For example, if the athlete wants to increase his speed for sprinting he wants to train the white twitch fibers by using a maximum amount of resistance through a lower number of repetitions for a large number of sets at a fast pace with small intervals of rests. A further attribute is the horizontal positioning of the body reclining on a mechanical platform with both feet affixed to a guided system. The mechanical attachments or harnesses are specifically designed and aligned to facilitate the positioning of the body and legs to replicate the motion of running without impact, without gravity, and without collateral damage to other body parts. Finally, the functionality of the apparatus provides a full range of motion of the controlled leg movement using both anaerobic and aerobic techniques and employing a variable work/energy relationship of weight resistance. This resistance extends or radiates throughout the entire extensor muscles of the hip, knee, and ankle joints (See FIG. 6). The distance through which each of these muscle groups exerts force is important in determining the force and velocity of the body of a user at "take off" which in turn determines the amount of muscular conditioning and can affect the speed of the user/athlete.

The preferred embodiment of the vertical running machine is comprised of: a) a structure framework configured as a group of horizontal, vertical, diagonal and cantilevered tubes interconnected with a means to fasten the ends of each tube to the adjoining tube; b) a movable seat for a user, the seat having a movable back and a group of vertical structural members affixed to the framework at one end and the seat at the opposite end; c) a group of pulleys affixed by a means for removably securing each of the pulley to the structure framework; d) a pair of cables with opposite ends, each cable with a first end removably secured by a means for securing the cable to one of a pair of foot harnesses and each cable at an opposite end removably affixed to a means (winch or hydraulic unit) for tensioning and pulling by a means for securing the cable, whereby the means for tensioning and pulling can then controllably cycle and release each foot harness; e) a programmable computer for engaging the means for tensioning and pulling and for controllably releasing the tension, and the programmable computer for controlling a weight applied, for controlling a speed of cycling the tensioning and release, and for controlling a length/stride of the movement; f) a pair of controller sticks and/or a set of buttons near the user and attached to the seat as a means to control the computer/controller; g) a means for powering the computer/controller; and h) a control and power cable to interconnect the means for powering (power source), computer and controls at the seat wherein the vertical running machine removes the effect of gravity on the joints and bones while running without impact.

OBJECTS AND ADVANTAGES

There are several objects and advantages of the VARRI—A Vertical Running Machine such as:

| Item | Advantages |
|---|---|
| 1 | removes the effects of gravity from the running exercise |
| 2 | duplicates the act of running |
| 3 | provides an electronic weight resistance system |
| 4 | can incorporate a pneumatic free weight system |
| 5 | can convert the sit down chair into a horizontal platform |
| 6 | can run or provide using a prescribed program for a work-out |
| 7 | is a non-impact rehabilitation |
| 8 | can be incorporated with and applied to Physical Therapy procedures |
| 9 | is a safer and faster methodology of recovery from surgery and athletic injuries |
| 10 | is adaptable to the bedridden patients in hospital beds following the same functionality guidelines |
| 11 | is useable for the rehabilitation of the sick and elderly who cannot bear weight on their skeletal muscle groups |
| 12 | helps in the prevention of injuries by strengthening the hamstrings and quadriceps |
| 13 | is an apparatus which is designed specifically to train the body's muscle fibers in such a manner as to make a change in the fiber constituents, without impact or deviation or compromise of other affiliated body parts |
| 14 | allows the user to rehabilitate or maximize his or her own potential in any desired field of health and fitness or athletic performance |

Finally, other advantages and additional features of the present VARRI—A Vertical Running Machine will be more apparent from the accompanying drawings and from the full description of the components and system. For one skilled in the art of exercise and running devices as well as the effects of gravity and impact on joints and muscles, it is readily understood that the features shown in the examples with this product are readily adapted to other types of exercise and rehabilitation devices and systems.

BRIEF DESCRIPTION OF THE DRAWINGS

The accompanying drawings, which are incorporated in and constitute a part of this specification, illustrate an embodiment of the VARRI—A Vertical Running Machine for exercise and rehabilitation. The drawings together with the summary description given above and a detailed description given below serve to explain the principles of the VARRI—A Vertical Running Machine. It is understood, however, that the device and system, called the VARRI is not limited to only the precise arrangements and instrumentalities shown.

FIG. 4C show optional push-pull devices to assist cable movement.

FIG. 10 is a results table of the muscle reaction forces and joint reaction forces which were measured during running and during use of the VARRI, Vertical Running Machine.

REFERENCE NUMERALS

Figure 1A:
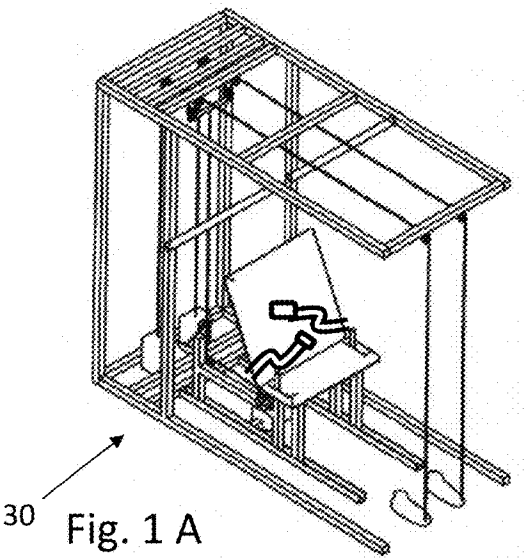
FIGS. 1A through 1D are sketches of the general VARRI—A Vertical Running Machine—Vertical, Anti-Gravity, Rehabilitation, Recovery, Impact Resistant.
Figure 1B:
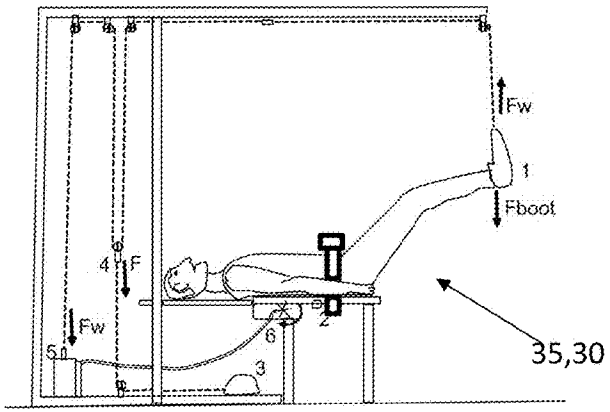
Figure 1C:
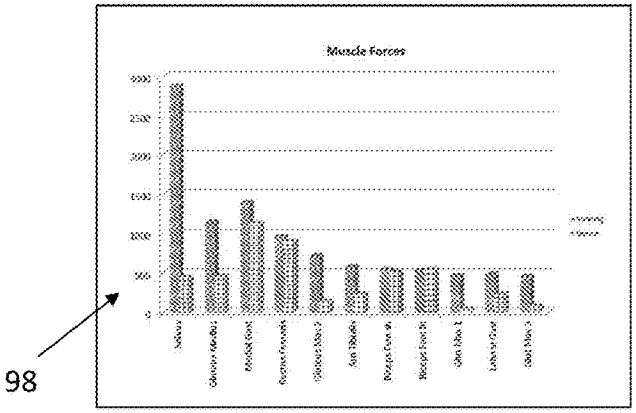
Figure 1D:
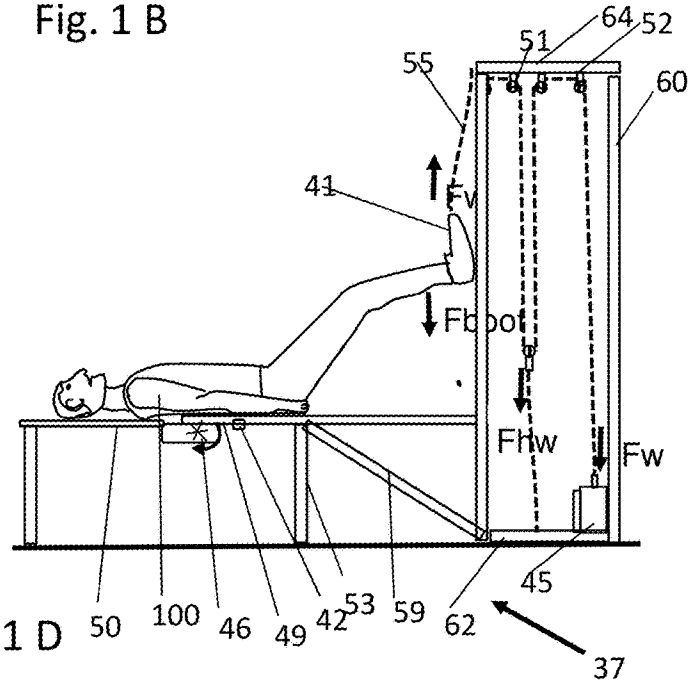

The following list refers to the drawings:

| Ref # | Description |
|---|---|
| 30 | VARRI - A Vertical Running Machine 30 - Vertical, Anti-Gravity, Rehabilitation, Recovery, Impact Resistant |
| 35 | operating sketch 35 of vertical running machine 30 |
| 37 | prototype 37 VARRI with reverse order of preferred embodiment 30, prototype having a structure 60, 62, 64, weights 45, cables 55, and pulleys 51 to the front of the user 100, while the seat 49, 50, foot harness 41, etc. is similar to preferred embodiment 30 |
| 41 | feet harnesses 41 and means for securing the feet of a user to the cable system of the Vertical Running Machine 30 |
| 41A | step in half-shoe foot harness 41A |
| 41B | step in full with heel shoe 41B |
| 41C | step in self-tightening loops 41C |
| 42 | stride adjustment button 42 |
| 43 | winch mechanism 43 |
| 44 | hydraulic mechanism 44 |
| 45 | resistance weights 45 |
| 46 | adjustment knob 46 |
| 47 | means 47 for connecting cable 55 to another cable, structure or weights |
| 48 | slide base 48 for stride adjustment |
| 49 | chair 49 |
| 50 | chair back 50 |
| 51 | pulley 51, wheel, gear, or the like |
| 51A | powered pulley 51A, as a single or pair, mounted contiguous to cable 55 and programmed from computer 70 to tension, then slack the cable 55 and assist an infirm user 100 |
| 52 | means 52 for securing pulley 51 to structure |
| 53 | vertical supports 53 for chair 49 |
| 54 | security belt 54 |
| 55 | cable 55, rope, cord or the like |
| 56 | optional assist push-pull 56 device to assist infirm persons 100 with weak muscles during rehabilitation and therapy to move the weights 45 on the cables 55 by applying tension with the movement of the powered pulleys 51A |
| 56A, C | optional cable assist 56, horizontally 56A or vertically 56C mounted with two powered pulleys 51A each cammed contiguously against spring mounted idler pulleys 57 and controlled from the computer module 70 |
| 56B | optional cable assist 56, mounted above 56B the cables with a single powered pulley 51A, cammed contiguously against spring mounted idler pulleys 57 and controlled from the computer module 70 |
| 57 | spring mounted idler pulleys 57 |
| 58 | optional extended telescoping features 58 for tubing and structural members 60, 62, 64, 65, 66 |
| 58A | optional retracted telescoping features 58 for tubing and structural members 60, 62, 64, 65, 66 |
| 58B | base/inner member 58B with spring ball or pin 58SB |
| 58E | one or more extended/outer member 58E with multiple apertures or holes 58H to accept spring ball or pin 58SB |
| 58F | end footer or cap 58F at floor end of the base tube 58B |
| 58H | apertures or holes 58H to accept spring ball or pin 58SB |
| 59 | support structures 59 |
| 60 | vertical tubing 60 or similar structure component |
| 62 | horizontal base tubing 62 or similar structure component |
| 64 | horizontal tubing 64 or similar structure component |
| 65 | horizontal cross support 65 |
| 66 | horizontal cantilevered tubing 66 or similar structure component |
| 70 | controller or computer 70 |
| 73 | hand controls and grips 73 at seat 49 |
| 75 | control and electrical wiring 75 from buttons to computer control 70 |
| 76 | power source and plug-in 76 |
| 77 | structural cross sections 77 |
| 78 | structural channel 78 |
| 79 | wide flange W beam 79 |
| 80 | standard I beam 80 |
| 81 | Tee beam 81 |
| 82 | square or rectangular tubing 82 |
| 83 | round tubing or pipe 82 |
| 85 | chart 85 of running biomechanics and sketches of force reactions at joints |
| 88 | simulating running 88 position of a user 100 |
| 89 | simulating reclining 89 by a user 100 in the Vertical Running Machine 30 |
| 90 | skeletal depiction 90 of the lower human anatomy showing where the joint reaction forces are measured during running 88 and during use 89 of the VARRI, Vertical Running Machine 30 |
| 91 | skeletal depiction 91 of the ankle area showing where the joint reaction forces are measured during running 88 and during use 89 of the VARRI, Vertical Running Machine 30 |
| 92 | muscular and skeletal depiction 92 demonstrating where the muscle reaction forces are measured during running 88 and during use 89 of the VARRI, Vertical Running Machine 30 |
| 93 | results table 93 of the muscle reaction forces and joint reaction forces |
| 95 | bar plot 95 comparing the peak joint reaction forces (as Newtons) between running and the VARRI device |
| 98 | bar plot 98 comparing the peak muscle forces (as Newtons) between running and the VARRI device |
| 100 | user 100 of the Vertical Running Machine 30 |
| 110 | free body diagram 110 |
| F.AT | force F.AT in anterior tibial |
| F.C | force F.C in calves |
| F.G | force F.G in ground |
| F.H | force F.H in hamstrings |
| F.Q | force F.Q in quadriceps |
| F.he | force F.he in hip extensors |

-continued

| Ref # | Description |
|---|---|
| F.rf | force F.rf in rectus femoris |
| F.W | force F.W in weights and cables |
| F.boot | force F.boot in boot or harness system |
| F.hw | force F.hw in winch or hydraulic system |
| A | force A at the hip and femur Joint reaction force 98 in the X, Y, and Z directions or plane |
| B | force B at the knee and tibia Joint reaction force 98 in the X, Y, and Z directions or plane |
| C | force C at the tibia and talus at ankle Joint reaction force 98 in the X, Y, and Z directions or plane |
| M | peak muscle force M as muscle force 95 in the Soleus |
| N | peak muscle force N as muscle force 95 in the Gluteus Medius |
| O | peak muscle force O as muscle force 95 in the Medial Gastrocnemius |
| P | peak muscle force P as muscle force 95 in the Rectus Femoris |
| Q | peak muscle force Q as muscle force 95 in the Gluteus Maximus 2 |
| R | peak muscle force R as muscle force 95 in the Anterior Tibialis |
| S | peak muscle force S as muscle force 95 in the Biceps Femoris short head |
| T | peak muscle force T as muscle force 95 in the Biceps Femoris long head |
| U | peak muscle force U as muscle force 95 in the Gluteus Maximus 1 |
| V | peak muscle force V as muscle force 95 in the Lateral Gastrocnemius |
| W | peak muscle force W as muscle force 95 in the Gluteus Maximus 3 |

DETAILED DESCRIPTION OF PREFERRED EMBODIMENT

This invention relates to THE VARRI—A Vertical Running Machine which is an acronym for Vertical, Anti-Gravity, Rehabilitation, Recovery, Impact Resistant. This bio-mechanical technology relates to the relationship of gravity and the functionality of the body in motion. This invention relates to the field of the biomechanics of running without repetitive impact or deviation cause by gravitational forces which can compromise affiliated body parts. The device relates to an anti-gravity running device that provides a non-impact rehabilitation and training system which eliminates the gravitational impact on the body's joints and bones. The present technology relates to the relationship of gravity and the functionality of the body in motion utilizing bio-mechanical technology. Finally, the invention relates to a simulation system and method with a computer-readable medium for synthesis and analysis of human motion under partial assist from powered exercise devices.

The advantages for the VARRI—A Vertical Running Machine 30 are listed above in the introduction. Succinctly the benefits are that the device:

A. removes the effects of gravity from the running exercise;
B. duplicates the act of running;
C. provides an electronic weight resistance system;
D. can incorporate a pneumatic free weight system;
E. can convert the sit down chair into a horizontal platform;
F. can run or provide using a prescribed program for a work-out;
G. is a non-impact rehabilitation;
H. can be incorporated with and applied to Physical Therapy procedures;
I. is a safer and faster methodology of recovery from surgery and athletic injuries;
J. is adaptable to the bedridden patients in hospital beds following the same functionality guidelines;
K. is useable for the rehabilitation of the sick and elderly who cannot bear weight on their skeletal muscle groups;
L. helps in the prevention of injuries by strengthening the hamstrings and quadriceps;
M. is an apparatus which is designed specifically to train the body's muscle fibers in such a manner as to make a change in the fiber constituents, without impact or deviation or compromise of other affiliated body parts; and
N. allows the user to rehabilitate or maximize his or her own potential in any desired field of health and fitness or athletic performance.

The preferred embodiment of the vertical running machine is comprised of: a) a structure framework configured as a group of horizontal, vertical, diagonal and cantilevered tubes interconnected with a means to fasten the ends of each tube to the adjoining tube; b) a movable seat for a user, the seat having a movable back and a group of vertical structural members affixed to the framework at one end and the seat at the opposite end; c) a security belt; d) a group of pulleys affixed by a means for removably securing each of the pulley to the structure framework; d) a pair of cables with opposite ends, each cable with a first end removably secured by a means for securing the cable to one of a pair of foot harnesses and each cable at an opposite end removably affixed to a means (winch or hydraulic unit) for tensioning and pulling by a means for securing the cable, whereby the means for tensioning and pulling can then controllably cycle and release each foot harness; e) a programmable computer for engaging the means for tensioning and pulling and for controllably releasing the tension, and the programmable computer for controlling a weight applied, for controlling a speed of cycling the tensioning and release, and for controlling a length/stride of the movement; f) a pair of controller sticks and/or a set of buttons near the user and attached to the seat as a means to control the computer/controller; g) a means for powering the computer/controller; and h) a control and power cable to interconnect the means for powering (power source), computer and controls at the seat wherein the vertical running machine removes the effect of gravity on the joints and bones while running without impact.

There is shown in FIGS. 1-12 a complete description and operative embodiment of the VARRI—A Vertical Running Machine 30. In the drawings and illustrations, one notes well that the FIGS. 1-12 demonstrate the general configuration and use of this device and system. The various example uses are in the operation and use section, below.

The accompanying drawings, which are incorporated in and constitute a part of this specification, illustrate an embodiment of the VARRI—A Vertical Running Machine 30 that is preferred. The drawings together with the summary description given above and a detailed description given below serve to explain the principles of the Vertical Running Machine 30. It is understood, however, that the device and system VARRI 30 is not limited to only the precise arrangements and instrumental-ities shown. Other examples of exercise and rehabilitation devices which lessen the effects of impact and gravity are still understood by one skilled in the art of exercise and rehabilitation devices to be readily adapted to features and concepts within the scope and spirit shown here.

For the purpose of establishing an understanding of the principles of the invention and providing it's currently understood best mode of operation, reference will now include the embodiments which will be used to describe the same. It will nevertheless be understood that no limitations of the scope of the invention is thereby intended, with such alterations and further modifications in the illustrated device and such further applications of the principles of the invention as illustrated therein being contemplated as would normally occur to one skilled in the art to which the invention relates.

FIGS. 1A through 1D are sketches of the general VARRI—A Vertical Running Machine as an acronym for Vertical, Anti-Gravity, Rehabilitation, Recovery, Impact Resistant. Shown in these general views are: a VARRI—A Vertical Running Machine 30; a sketch of an operating 35 vertical running machine 30; a bar plot 98 comparing the peak muscle forces (shown in Newtons) between running and a user on the VARRI device 30; and a prototype 37 VARRI with reverse order of preferred embodiment 30, prototype having a structure 60, 62, 64, weights 45, cables 55, and pulleys 51 to the front of the user 100, while the seat 49, 50, foot harness 41, etc. is similar to preferred embodiment 30. The prototype can be further described as a vertical running machine that is comprised of: a) a structure framework made of durable materials and configured as a group of horizontal, vertical, diagonal and cantilevered tubes, each tube having opposite ends, and the ends are interconnected with a means for fastening the ends of each tube to the adjoining tube; b) a movable seat for a user positioned in front of the framework and a group of vertical structural members affixed to the framework at leg end and the seat at the opposite of the leg end, wherein the legs of the use are positioned between the framework and the seat, and wherein the seat has a movable back; c) a group of pulleys affixed by a means for removably securing each of the pulley to the structure framework; e) a pair of cables with opposite ends, each cable with a first end removably secured by a means for securing the cable to one of a pair of foot harnesses and each cable at an opposite end removably affixed to a means for tensioning and pulling by a means for securing the cable, whereby the means for tensioning and pulling can then controllably cycle and release each foot harness; and d) a manual means for engaging the means for tensioning and pulling and for controllably releasing the tension and for controlling a weight applied and for controlling a speed of cycling the tensioning and release wherein the vertical running machine removes the effect of gravity on the joints and bones while running without impact and can be utilized for therapeutic use. Component and features of these machines are detailed in the below paragraphs.

Figure 2B:
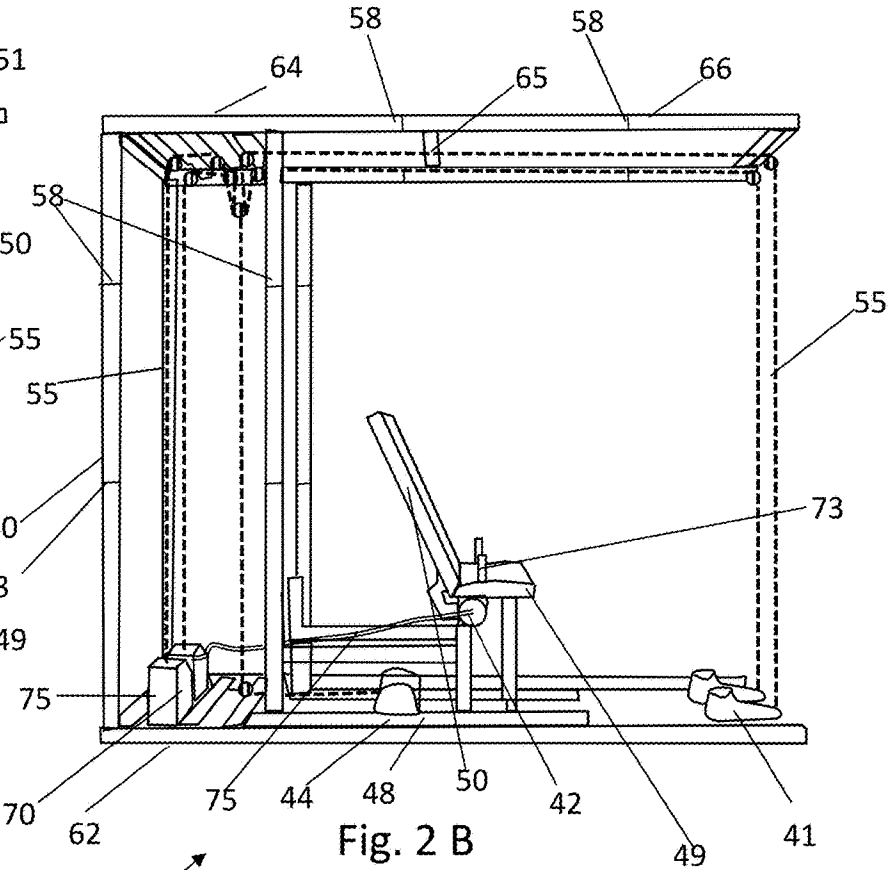
FIGS. 2A through 2C are an isometric, a side view sketch, and the telescoping feature of the general VARRI—A Vertical Running Machine with components and features noted.
Figure 2A:
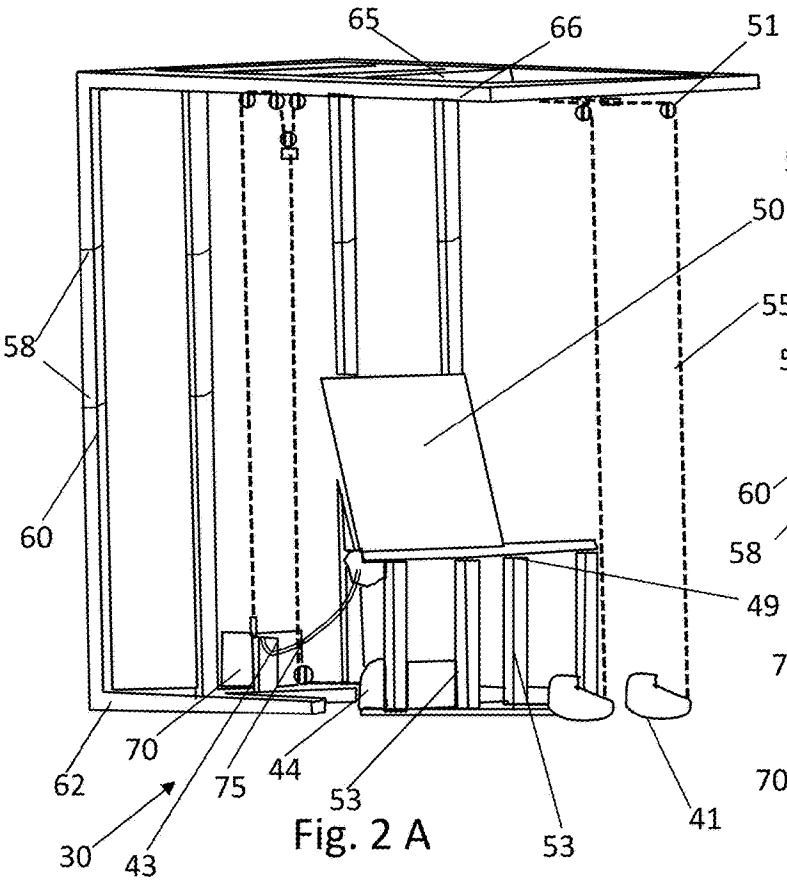
Figure 2C:
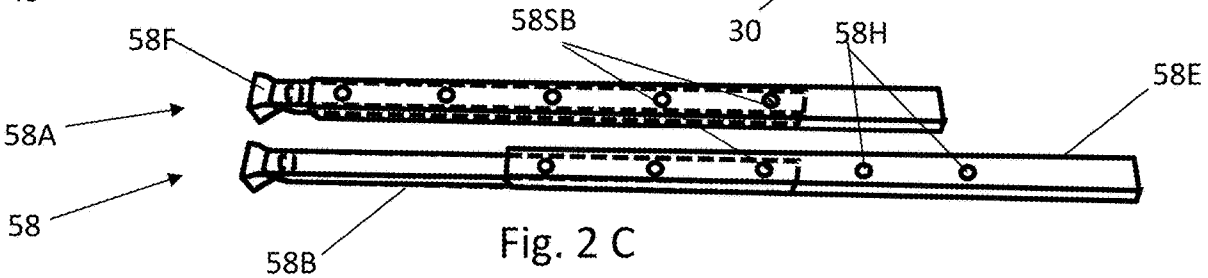

FIGS. 2A through 2C are an isometric, a side view sketch, and the telescoping feature of the general VARRI—A Vertical Running Machine with components and features noted. In view FIGS. 2A and 2B are portrayed: a VARRI—A Vertical Running Machine 30; a pair of feet harnesses 41 and means for securing the feet of a user to the cable system of the Vertical Running Machine 30; a stride adjustment button 42; a winch mechanism 43; a hydraulic mechanism 44 (the winch 43 or hydraulic unit 44 is a means for tensioning and pulling the cable and then controllably cycle and release each foot harness according the computer 70 and program pre-set for the user 100); a group of resistance weights 45; an adjustment knob 46; a means 47 for connecting cable 55 to another cable, structure or weights; a chair 49; a chair back 50; a pulley 51, wheel, gear, or the like; a means 52 for securing pulley 51 to structure; a group of vertical supports 53 for chair 49; a cable 55, rope, cord or the like; optional telescoping features 58 for tubing and structural members 60, 62, 64, 65, 66; a support structures 59; a vertical tubing 60 or similar structure component; a horizontal base tubing 62 or similar structure component; a horizontal tubing 64 or similar structure component; a horizontal cross support 65; a horizontal cantilevered tubing 66 or structure; a controller or computer 70; a set of hand controls and grips 73 at seat 49; a control and electrical wiring 75 from buttons to computer control 70; and a power source and plug-in 76. In FIG. 2C are portrayed: an optional extended telescoping features 58 for tubing and structural members 60, 62, 64, 65, 66; an optional retracted telescoping features 58 for tubing and structural members 60, 62, 64, 65, 66; a base/inner member 58B with spring ball or pin 58SB; at least one or more extended/outer member 58E with multiple apertures or holes 58H to accept spring ball or pin 58SB; an end footer or cap 58F at floor end of the base tube 58B; a set of apertures or holes 58H to accept spring ball or pin 58SB and adjust the length of the telescoping member. This configuration is similar for vertical, horizontal and angled telescoping structural members.

Figures 3A, 3B, 3C:
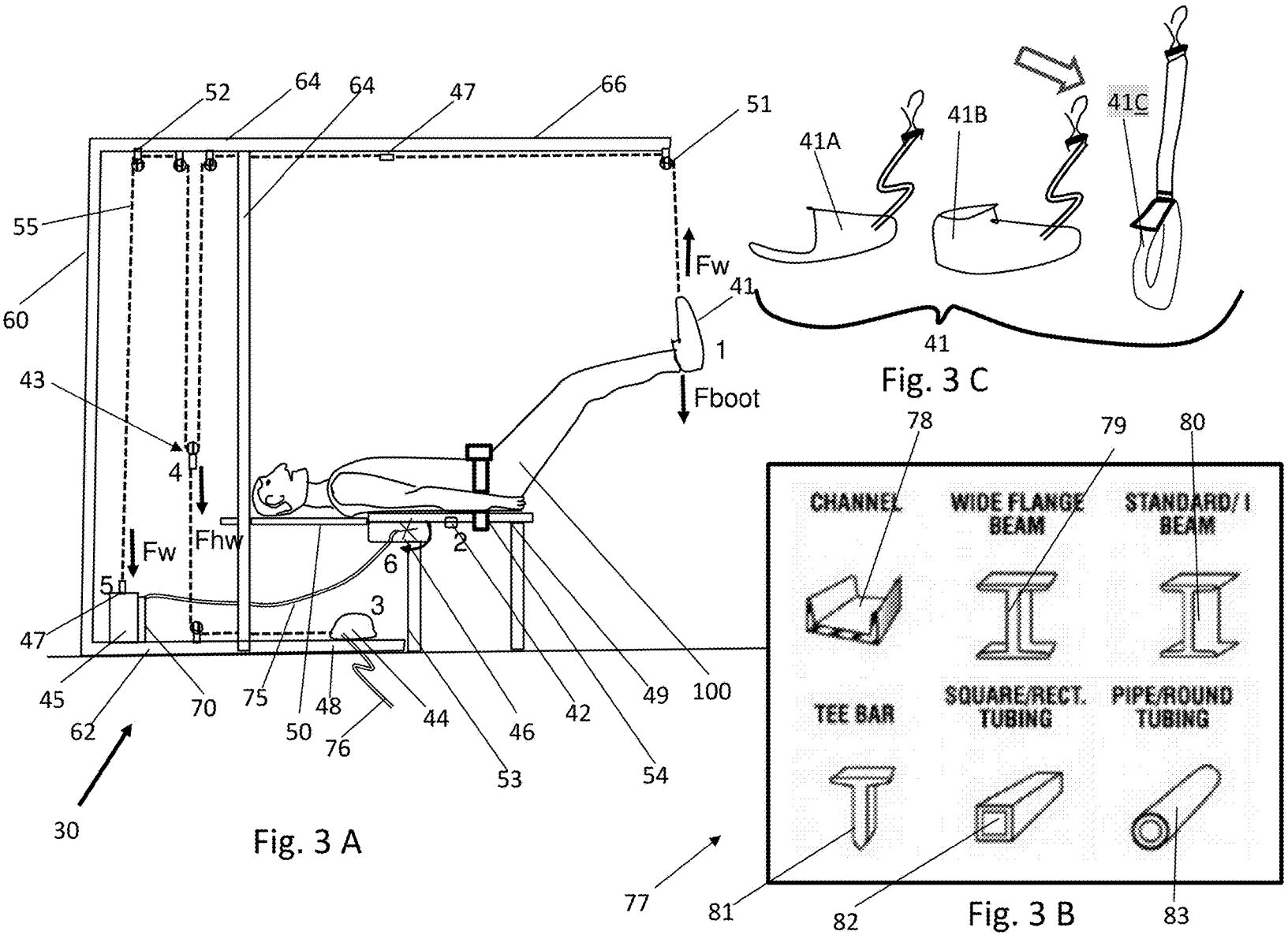
FIG. 3A through 3C are sketches of the general VARRI—A Vertical Running Machine in use (FIG. 3A), a set of cross sections anticipated (FIG. 3B), for the types of structural members of the VARRI—A Vertical Running Machine, and a set of optional feet harnesses (FIG. 3C).

FIG. 3A through 3C are sketches of the general VARRI—A Vertical Running Machine in use (FIG. 3A), a set of cross sections anticipated (FIG. 3B), for the types of structural members of the VARRI—A Vertical Running Machine, and a set of optional feet harnesses (FIG. 3C). FIG. 3A demonstrates once more the following components: a VARRI—A Vertical Running Machine 30; a pair of feet harnesses 41 and means for securing the feet of a user to the cable system of the Vertical Running Machine 30; a stride adjustment button 42; a winch mechanism 43; a hydraulic mechanism 44 (the winch 43 or hydraulic unit 44 is a means for tensioning and pulling the cable and then controllably cycle and release each foot harness according the computer 70 and program pre-set for the user 100); a group of resistance weights 45; an adjustment knob 46; a means 47 for connecting cable 55 to another cable, structure or weights; a slide base 48 for stride adjustment; a chair 49; a chair back 50; a pulley 51, wheel, gear, or the like; a means 52 for securing pulley 51 to structure; a group of vertical supports 53 for chair 49; a security belt 54; a cable 55, rope, cord or the like; a support structures 59; a vertical tubing 60 or similar structure component; a horizontal base tubing 62 or similar structure component; a horizontal tubing 64 or similar structure component; a horizontal cross support 65; a horizontal cantilevered tubing 66 or structure; a controller or computer 70; a set of hand controls and grips 73 at seat 49; a control and electrical wiring 75 from buttons to computer control 70; and a power source and plug-in 76. The operation of this device 30 is described below in the operation section.

FIG. 3B are the cross sections of the various structural members 60, 62, 64, 65, etc. Here are shown the cross sections, as examples and not as limitations: structural cross sections 77; structural channel 78; wide flange W beam 79; standard I beam 80; Tee (T) beam 81; square or rectangular tubing 82; round tubing or pipe 82; and angle (L) members. The enclosed tubes are preferred due to the superior structural strength with relatively compact sizes but the structure can be other cross sectional members. Likewise, the ends, joints and corners can be beveled, angled, squared/perpendicular or curved as they flow and change directions for aesthetics and strength. The members/tubes anticipate having a telescoping feature to enable compact shipping and storage. There are many means to secure the structural tubes. These, as example and not as a limitation, are: welding, threaded fasteners, brazing, rivets, rods and cotter keys, rods with spring balls at the end, etc. The materials for the device 30, again for example and not as a limitation, include steel, steel alloy, stainless steel, aluminum, plastics, wood, composite materials, and the like with configurations and size to provide good strength when configured as the VARRI—A Vertical Running Machine 30. Likewise, whichever materials are used, they may be coated with paint, powdered metal, plating (chrome or other) and also can have surface finishes such as brushed, knurled, polished, lapped, and sand, pebble, or shell blasted. FIG. 3C demonstrates a set of optional feet harnesses. Here are shown, for example and not as a limitation, step in half-shoe foot harness 41A; step in full with heel shoe 41B, and step in self-tightening loops 41C. These provide a way for the user 100 to step into the device 30, tighten the foot harness 41 onto their feet, cinch up the security belt 54, set the stride by the button 42 which moves the stride length with the adjustable slide base 48 to the individual stride length of the user 100. Then the user 100 grips the handles 73 and can lay the seat back 50 to a horizontal position.

Figures 4A, 4B, 4C:
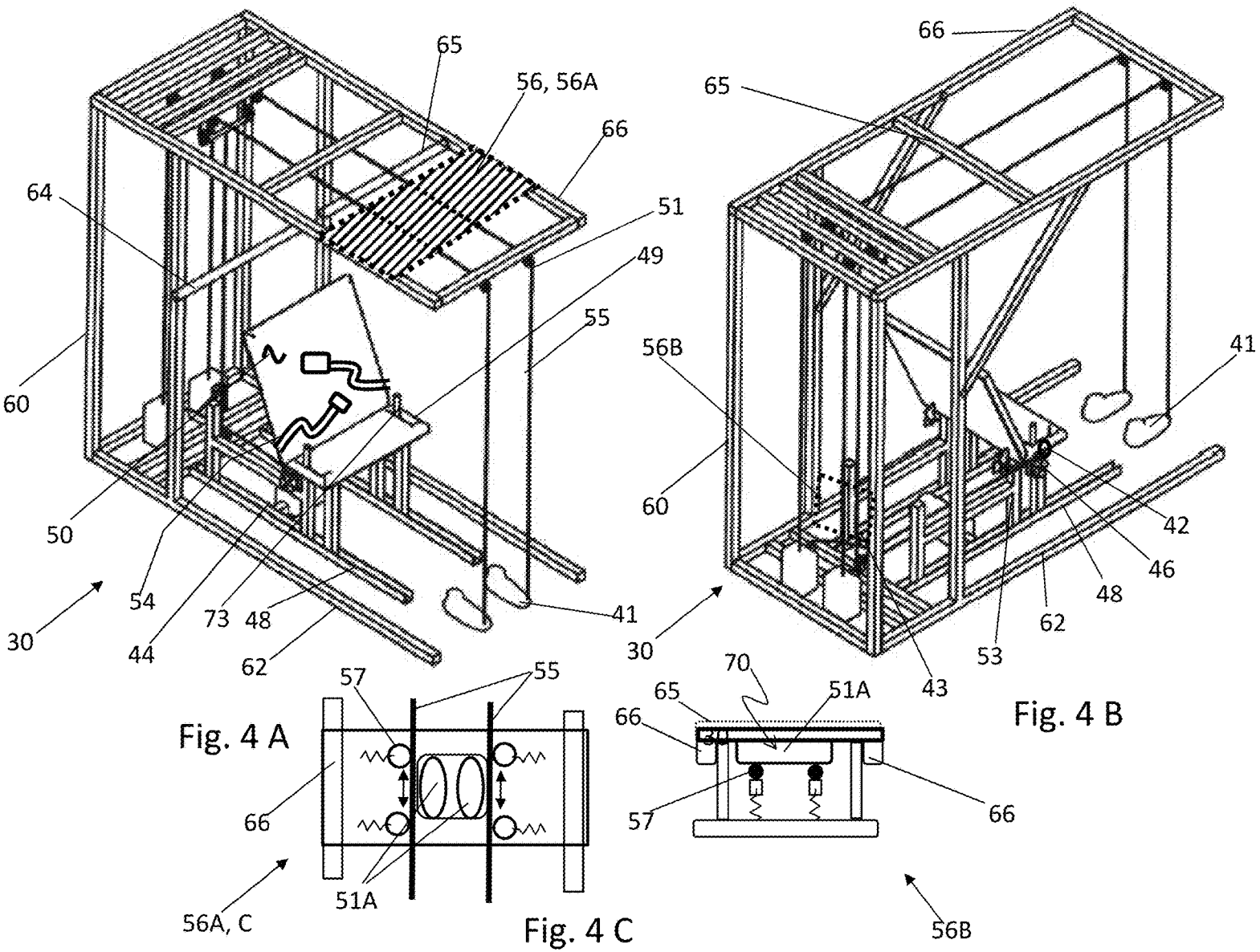
FIGS. 4A through 4C are front (FIG. 4A) and rear view (FIG. 4B) isometric sketches of the general VARRI—A Vertical Running Machine with components and features noted.
Figure 5C:
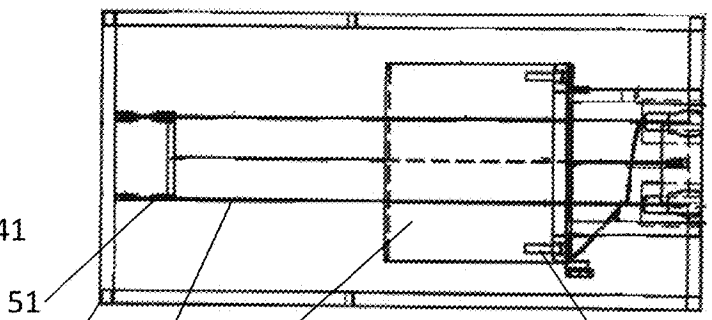
FIGS. 5A through 5D are more sketches of the general VARRI, Vertical Running Machine form top, side, end and isometric views with components and features noted.
Figure 5D:
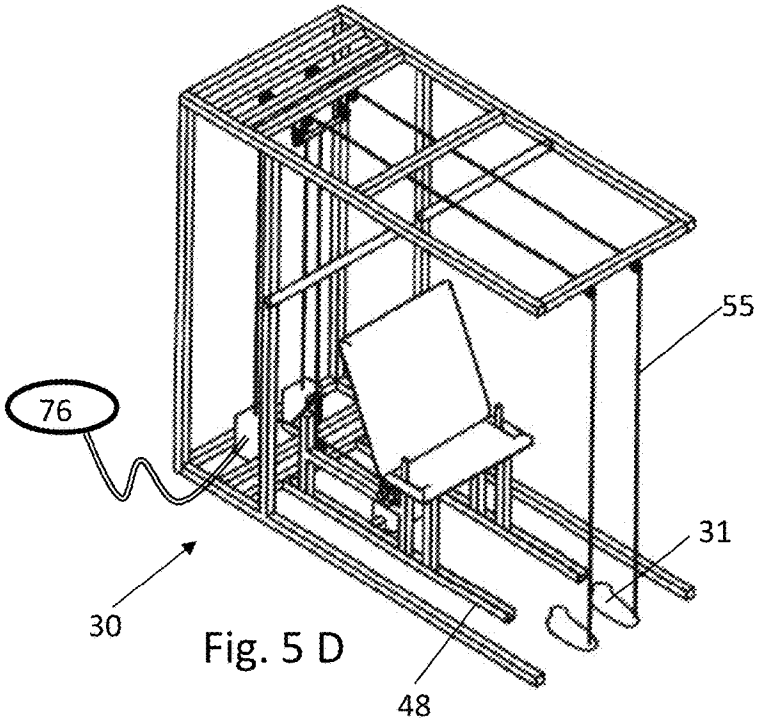
Figure 5B:
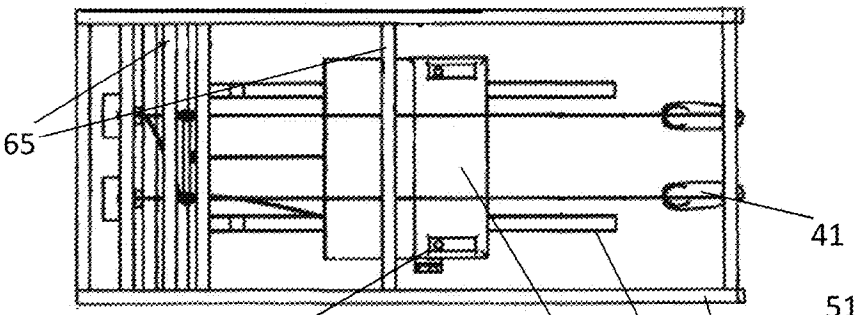
Figure 5A:
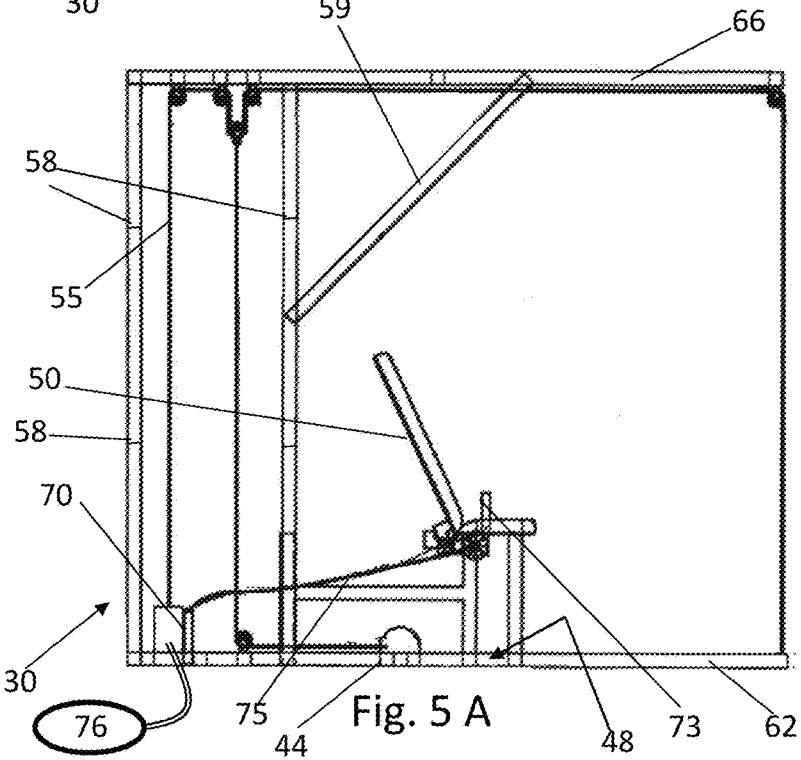

FIGS. 4A through 4C are front (FIG. 4A) and rear view (FIG. 4B) isometric sketches of the general VARRI—A Vertical Running Machine 30 with components and features noted. FIG. 4C show optional push-pull devices to assist cable movement. The components demonstrated here in FIGS. 4A and B include the a VARRI—A Vertical Running Machine 30; a pair of feet harnesses 41 and means for securing the feet of a user to the cable system of the Vertical Running Machine 30; a stride adjustment button 42; a winch mechanism 43; a hydraulic mechanism 44 (the winch 43 or hydraulic unit 44 is a means for tensioning and pulling the cable and then controllably cycle and release each foot harness according the computer 70 and program pre-set for the user 100); a group of resistance weights 45; an adjustment knob 46; a means 47 for connecting cable 55 to another cable, to a structure, to the foot harness 41 or weights 45; slide base 48 for stride adjustment; a chair 49; a chair back 50; a security belt 54 to safely keep a user 100 removably secured to the seat 49, 50; a pulley 51, wheel, gear, or the like; a cable 55, rope, cord or the like; a group of vertical supports 53 for chair 49; a support structures 59; a vertical tubing 60 or structure; a horizontal base tubing 62 or structure; a horizontal tubing 64 or structure; a horizontal cross support 65; a horizontal cantilevered tubing 66 or structure; and a set of hand controls 73 at seat 49. In FIG. 4C are shown optional assist push-pull 56 devices to assist infirm persons 100 with weak muscles during rehabilitation and therapy to move the weights 45 on the cables 55. This is accomplished by applying tension with the movement of the powered pulleys 51A. The optional cable assist 56 can be horizontally 56A or vertically 56C mounted. These have two powered pulleys 51A each and are cammed contiguously against a set of spring mounted idler pulleys 57. This is controlled from the computer module 70 for the individual user. Another optional cable assist 56 is mounted above 56B the cables with only a single powered pulley 51A, cammed contiguously against spring mounted idler pulleys 57. This too is controlled from the computer module 70. These views also show the spring mounted idler pulleys 57 as well as the powered pulley 51A contiguous to cable 55 and programmed from computer 70 to tension, then slack the cable 55 and assist an infirm user 100.

FIGS. 5A through 5D are more sketches of the general VARRI, Vertical Running Machine 30 form top, side, end and isometric views with components and features noted. The components portrayed in these sketches are: a VARRI—A Vertical Running Machine 30; a pair of feet harnesses 41 and means for securing the feet of a user to the cable system of the Vertical Running Machine 30; a stride adjustment button 42; a winch mechanism 43; a hydraulic mechanism 44; a group of resistance weights 45; an adjustment knob 46; a means 47 for connecting cable 55 to another cable, structure or weights; a slide base 48 for stride adjustment; a chair 49; a chair back 50; a pulley 51, wheel, gear, or the like; a means 52 for securing pulley 51 to structure; a cable 55, rope, cord or the like; optional telescoping features 58 for tubing and structural members 60, 62, 64, 65, 66; a support structures 59; a group of vertical supports 53 for chair 49; a vertical tubing 60 or structure; a horizontal base tubing 62 or structure; a horizontal tubing 64 or structure; a horizontal cross support 65; a horizontal cantilevered tubing 66 or structure; a controller or computer 70; a set of hand controls 73 at seat 49; a control and electrical wiring 75 from buttons to computer control 70; and a power source and plug-in 76.

Figure 6:
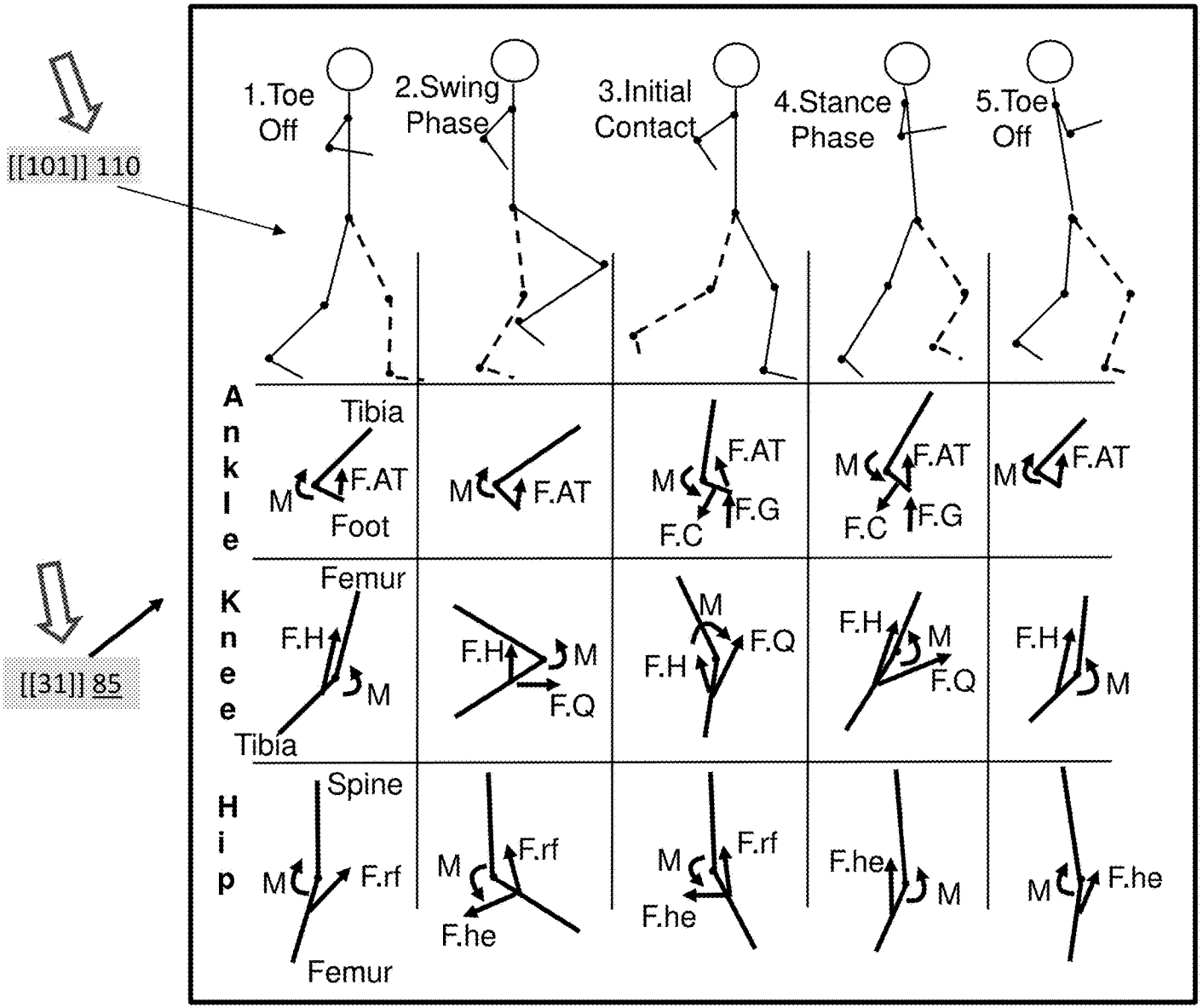
FIG. 6 is a table of the running biomechanics with a free body diagram of a person running and the resultant force diagrams at the ankle, knee and hip of the person during running.

FIG. 6 is a chart 85 of the running biomechanics with a free body diagram 110 of a person 100 running and the resultant force diagrams at the ankle, knee and hip of the person during running. The chart 85 of running biomechanics and sketches of force reactions at joints portrays the act of running involves the stabilization, propulsion, and braking of the body's center of gravity as a result of reaction forces between the bottom of the feet and the ground. This is called Running Biomechanics and is illustrated here fully in this FIG. 6. It is a simplified view of muscle activity while running may include the activities of lower extremity muscles, such as the hamstrings F.H, hip extensors F.he, rectus femoris F.rf, quadriceps F.Q, gastrocnemius (calf) F.C, and anterior tibial F.AT. Essentially, these muscles act to both rotate the joints and provide stability while the body's center of gravity moves forward and pushes against the ground. The act of running may be broken down into two phases, the stance and swing phase as shown by the diagram of the running cycle below. During the swing phase, the toe is raised off the ground (toe off) to provide clearance for swinging the leg forward. Subsequently, the toe or heel will make contact with the ground at the beginning of the stance phase. As the toe/heel makes contact, the body's joints and muscles act together to absorb the energy of impact due to the movement of the body's mass. The body's center of gravity is then moved forward as the muscles contract, rotating the joints and creating a force against the ground to propel the forward. The biomechanics of running is further explored by considering the joints involved and the forces around them.

Ankle: The anterior tibial F.AT and calf muscles F.C control the rotation of the ankle. The anterior tibial muscle works to dorsiflex the foot upward while the calf pulls the foot downward. A free body diagram 110 showing the muscle forces throughout the running cycle is below. While preparing for initial contact, the anterior tibial F.AT controls which part of the foot sole will make initial contact. In order to generate power for propulsion during the stance phase, the calf F.C becomes the primary active muscle as it creates the force against the ground F.ground by rotating the ankle and pulling the forefoot down against the ground. While the foot is in contact with the ground, the ankle joint will experience increased internal loading due to the ground reaction forces and the body's mass. Once the toe comes off the ground (swing phase), the anterior tibial muscles become more active as they dorsiflex the foot to provide ground clearance.

Knee: A free body diagram 110 of the knee rotation and the muscle forces during running can be found below. The hamstrings F.H and the quadriceps F.Q control the flexion and extension of the knee, respectively. During initial contact with the ground, both the hamstrings and quadriceps contract in order to help absorb the energy of impact with the ground. However, the knee joint will also experience increased internal loading here in order to dissipate the energy from impact. As the body moves through the stance phase, the knee joint will extend due to the quad contracting, increasing the force against the ground. Consequently, the knee joint continues to provide support by internal loading. Once the toe comes off the ground, the hamstrings become more active and cause the knee to flex in order to provide more ground clearance for swinging the leg.

Hip: A free body diagram of the hip rotation and the corresponding muscle forces can be found below. At the hip, the hip extensors F.he and rectus femoris F.rf are responsible for the extension and flexion of the hip. Similarly to the other joints, both muscles are active during initial contact in order to help absorb the impact. Additionally, the hip joint experiences an increased load during impact and while in the stance phase. Both muscles are active during the stance phase, but activity should increase in the hip extensors as the body moves forward and the hip extends back. Once the toe comes off the ground, the rectus femoris contracts in order to flex the hip and move the leg forward.

Figure 7A:
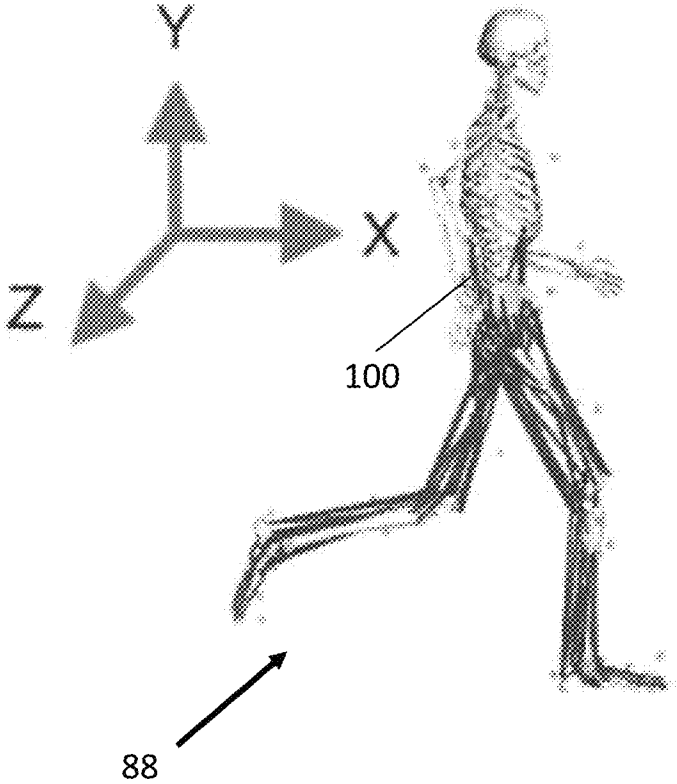
FIG. 7A is a Position of a user simulating running and FIG. 7B is simulating a user reclined in the Vertical Running Machine.
Figure 7B:
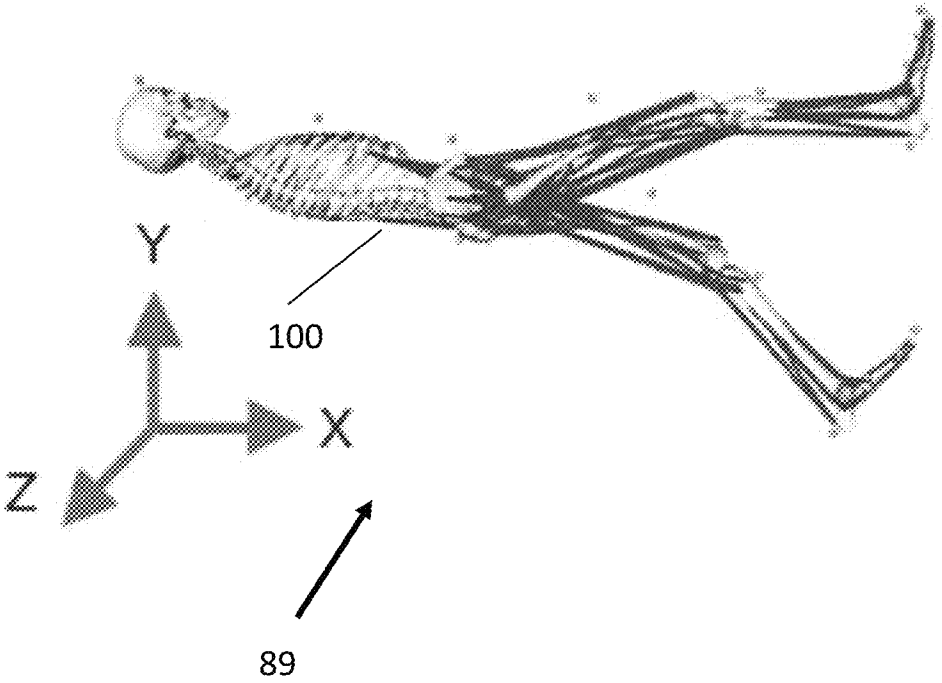

FIG. 7A is a Position of a user simulating running and FIG. 7B is simulating a user reclined in the Vertical Running Machine. The sketches shown here are: one simulating a running 88 position of a user 100 and the second simulating reclining 89 by a user 100 in the Vertical Running Machine 30. The muscle forces and joint reaction forces were analyzed and compared for running and the running device using the OpenSim (® by OpenSim Technology LLC) human motion simulation software or a comparable evaluation software. Thus software is applied for analysis when integrating Flow and Geomechanics on physical models such as seen here with reactions of movement and forces on the muscular skeletal frame. For the device simulation, a 10 pound (lb.) force was placed on the heel of each foot in the direction of the Y-axis (perpendicular to the ground plane). Then as with FIGS. 7A and 7B the simulation can show images of the running and device simulation, respectively, along with the coordinate system inlayed on each image.

Figure 8B:
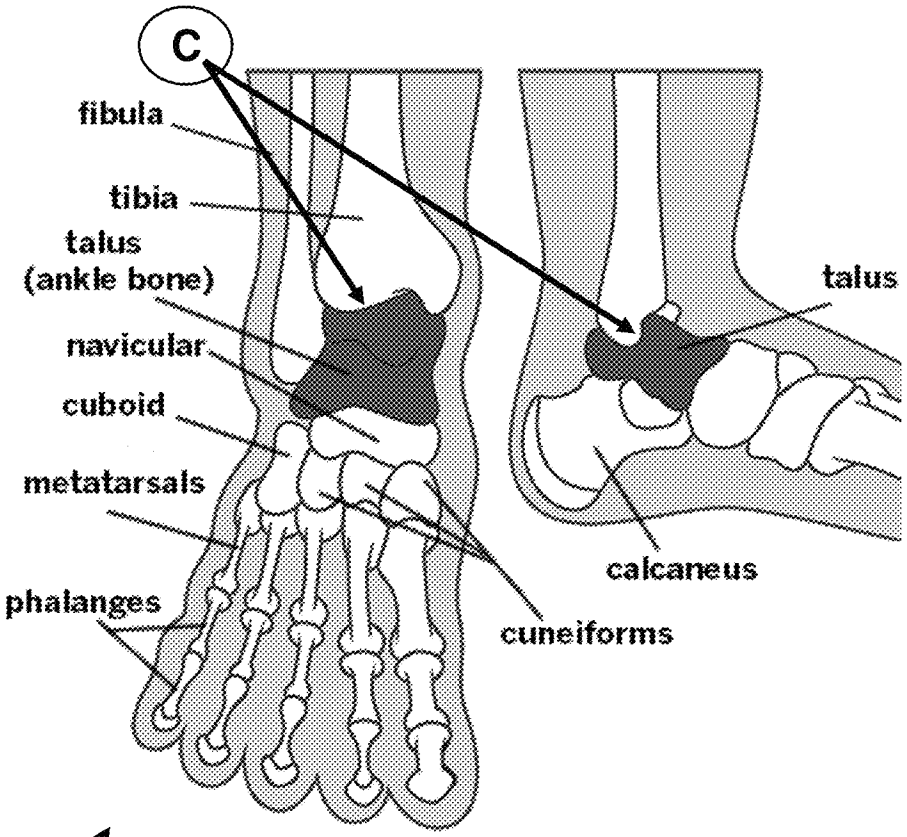
FIGS. 8A and 8B are sketches of a skeletal depiction showing where the joint reaction forces are measured during running and during use of the VARRI, Vertical Running Machine.
Figure 8A:
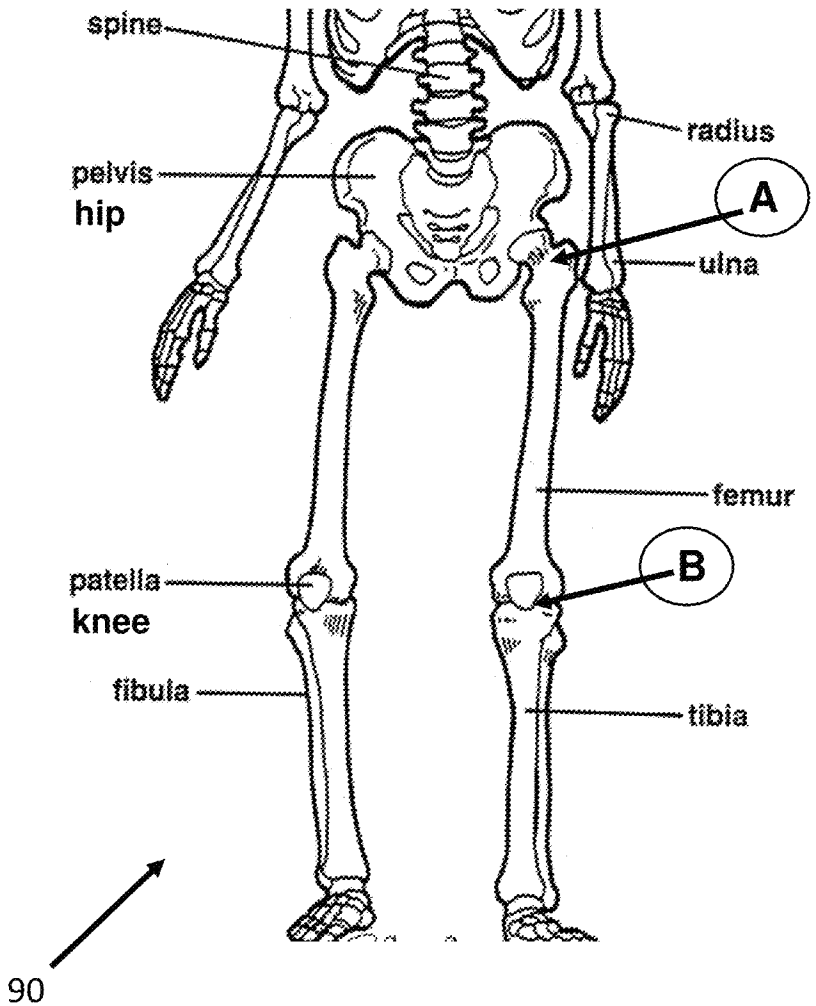

FIGS. 8A and 8B are sketches of a skeletal depiction showing where the joint reaction forces are measured during running and during use of the VARRI, Vertical Running Machine 30. In this view are depicted the FIG. 8A a skeletal depiction 90 of the lower human anatomy showing where the joint reaction forces are measured during running 88 and during use 89 of the VARRI, Vertical Running Machine 30. Also depicted is FIG. 8B a skeletal depiction 91 of the ankle area showing where the joint reaction forces are measured during running 88 and during use 89 of the VARRI, Vertical Running Machine 30. In the two figures, the points of measurement are shown as force A at the hip and femur Joint reaction force 98 in the X, Y, and Z directions or plane; force B at the knee and tibia Joint reaction force 98 in the X, Y, and Z directions or plane; and force C at the tibia and talus at ankle Joint reaction force 98 in the X, Y, and Z directions or plane. These results are analyzed by the OpenSim (® by OpenSim Technology LLC) human motion simulation software.

Figure 9:
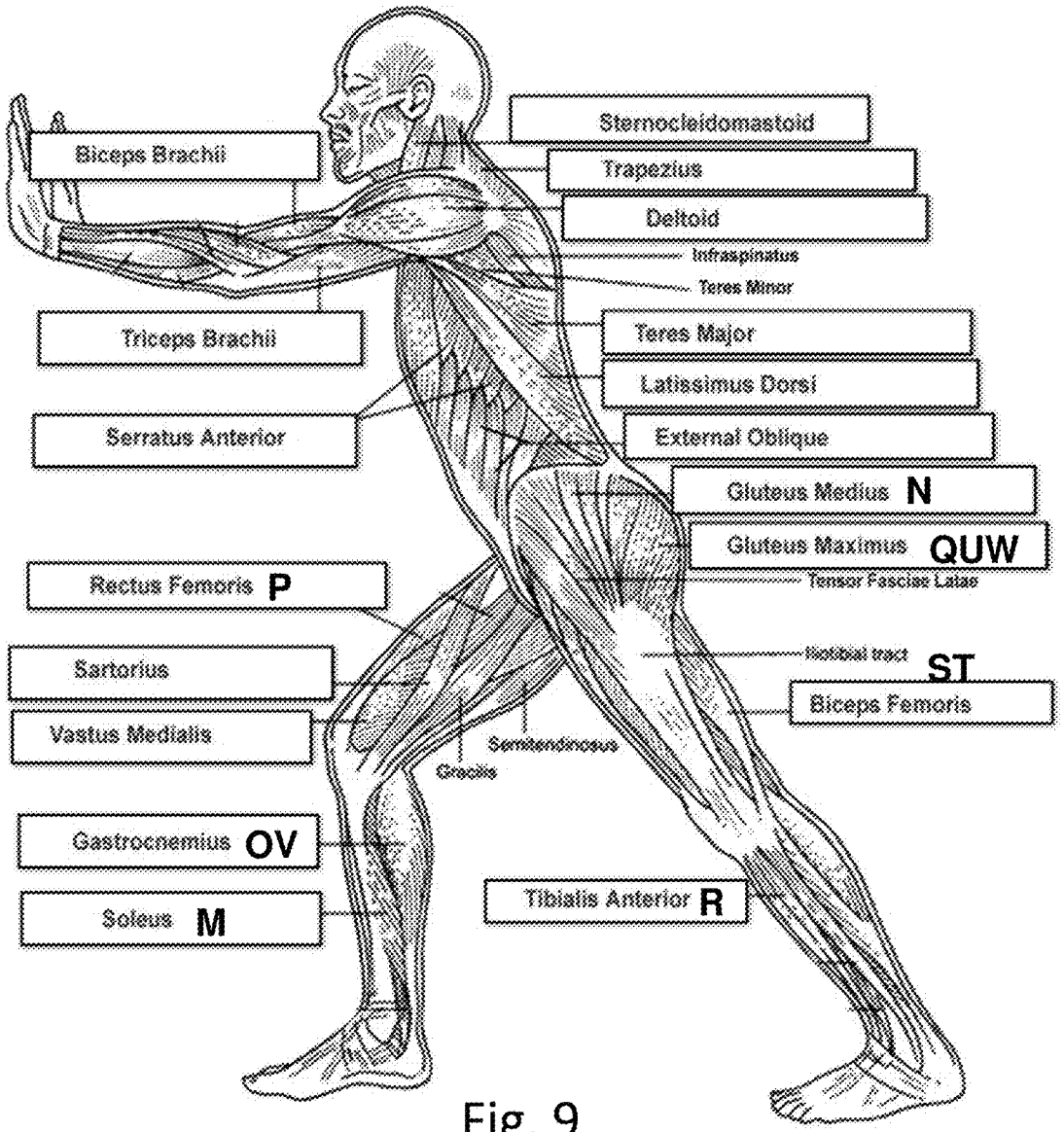
FIG. 9 is a sketch of a muscular and skeletal depiction demonstrating where the muscle reaction forces are measured during running and during use of the VARRI, Vertical Running Machine.

FIG. 9 is a sketch of a muscular and skeletal depiction 92 demonstrating where the muscle reaction forces are measured during running and during use of the VARRI, Vertical Running Machine. Here are shown a muscular and skeletal depiction 92 demonstrating where the muscle reaction forces are measured during running 88 and during use 89 of the VARRI, Vertical Running Machine 30. The forces measured are depicted as: a peak muscle force M as muscle force 95 in the Soleus; a peak muscle force N as muscle force 95 in the Gluteus Medius; a peak muscle force O as muscle force 95 in the Medial Gastrocnemius; a peak muscle force P as muscle force 95 in the Rectus Femoris; a peak muscle force Q as muscle force 95 in the Gluteus Maximus 2; a peak muscle force R as muscle force 95 in the Anterior Tibialis; a peak muscle force S as muscle force 95 in the Biceps Femoris short head; a peak muscle force T as muscle force 95 in the Biceps Femoris long head; a peak muscle force U as muscle force 95 in the Gluteus Maximus 1; a peak muscle force V as muscle force 95 in the Lateral Gastrocnemius; and a peak muscle force W as muscle force 95 in the Gluteus Maximus 3. Again, these results shown in FIGS. 8-12 are analyzed by the OpenSim (® by OpenSim Technology LLC) human motion simulation software.

FIG. 10 is a results table 93 of the muscle reaction forces and joint reaction forces which were measured during running and during use of the VARRI, Vertical Running Machine. The results table 93 of the muscle reaction forces and joint reaction forces is a table containing the peak muscle and joint reaction forces. Additionally, plots of the muscle and joint reaction forces for a single cycle are plotted at the end of this document. These plots show the muscle and joint forces as the person goes through a single cycle of leg motion from toe/heel down to push off (i.e. when the foot presses down on the ground, pushing the body forward). All of the points A-C, and M through W muscle and joint points and respective locations are described in the above paragraphs for FIGS. 8A and B and FIG. 9.

Figure 11:
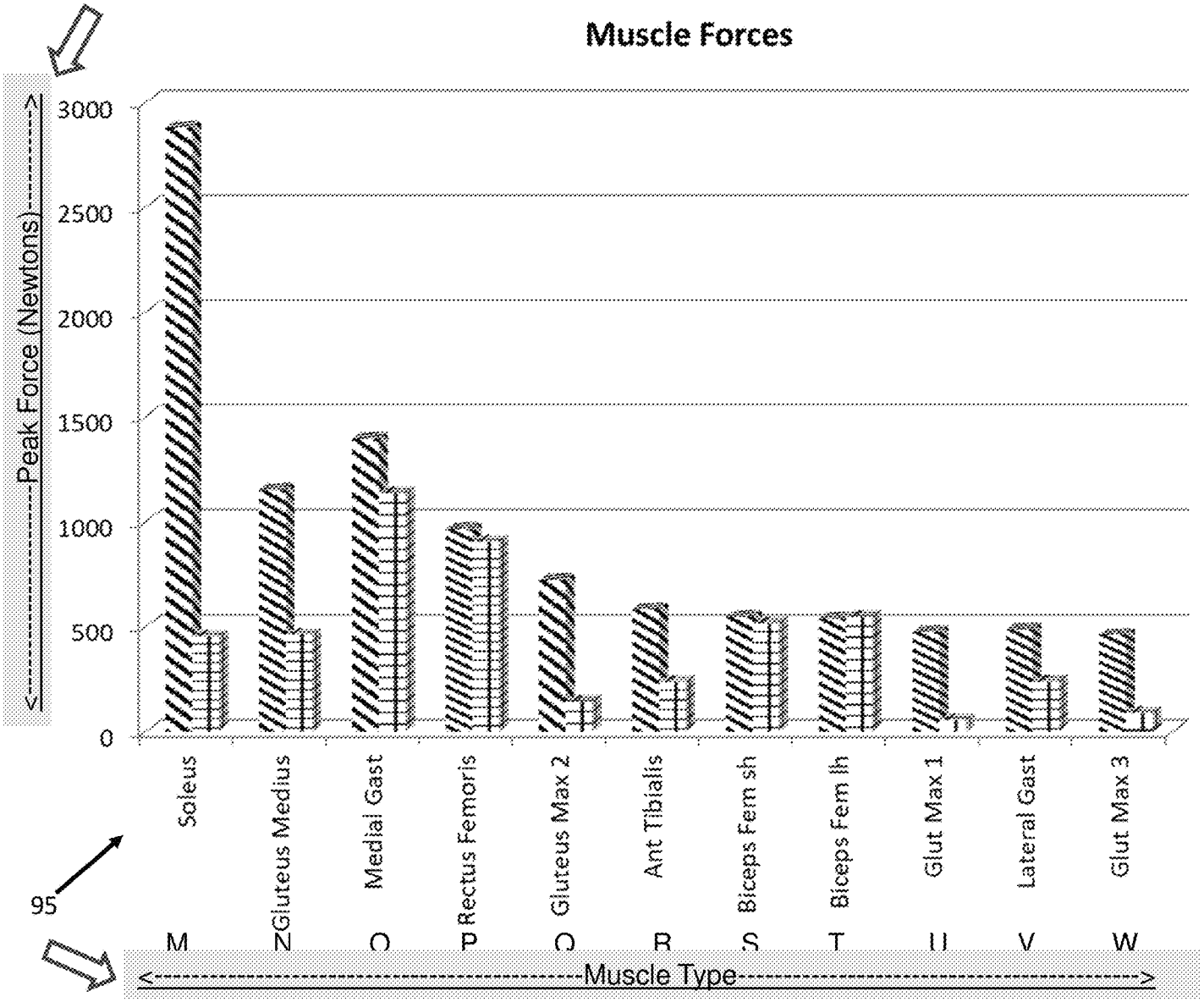
FIG. 11 is a bar plot comparing the peak muscle forces (shown as Newtons) between running and the VARRI device.

FIG. 11 is a bar plot 98 comparing the peak muscle forces M through W (in Newtons) between running and the VARRI device.

The FIG. 11 of the muscle peak muscle forces in units Newton's while running (diagonal lines) and using the device (horizontal lines). The simulation results indicate that with 10 pounds (lbs.) on each foot, the peak muscle forces are relatively preserved while using the device as compared to running. There is muscle activity in all of the major muscles and the forces are comparable. The medial gastrocnemius O, rectus femoris P, and biceps femoris short head S and long head T all output peak forces nearly identical to running. The lower peak forces in the soleus M, gluteus medius N, anterior tibialis R, and gluteus maximus muscles Q, U, W are likely due to the decreased amount of flexion and extension of the hip and ankle in the device simulation. By increasing the ankle and hip extension and flexion, the muscle forces will increase since the muscles will contract more in order to increase the amount of flexion and extension. Additionally, all muscle forces while using the device may be tuned by increasing or decreasing the weight on each foot. An increase in the weight will lead to large muscle forces while a decrease in weight will lead to a reduction in muscle forces. In contrast to the muscle forces, the forces experienced by the joints are not preserved and decrease substantially while using the device.

Figure 12:
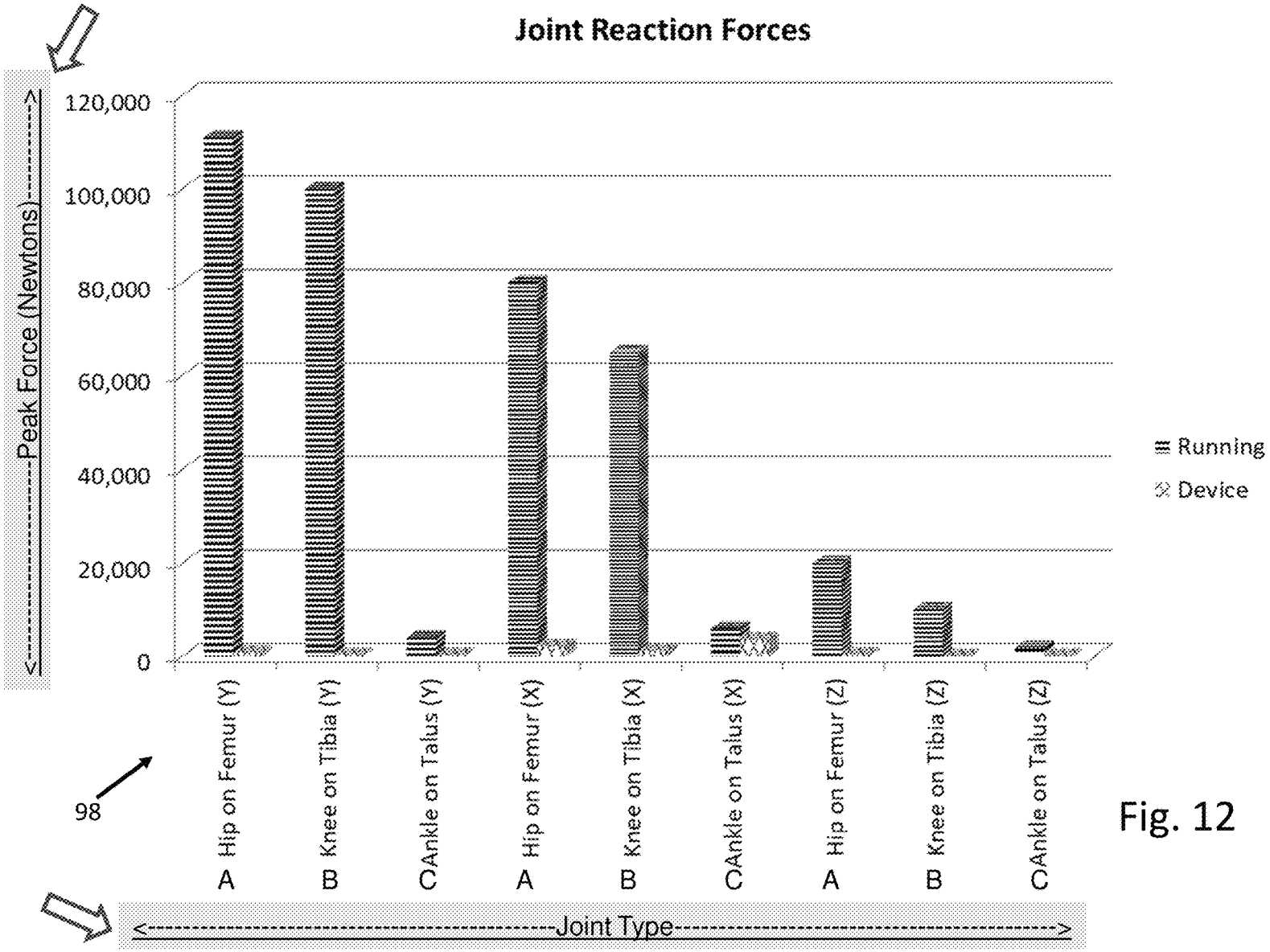
FIG. 12 is a bar plot comparing the joint reaction forces (shown as Newtons) between running and the VARRI device.

FIG. 12 is a bar plot 98 comparing the joint reaction forces (shown as Newtons) between normal upright running and using the VARRI device 30. FIG. 12 shows a bar plot of the peak joint reaction forces (shown in units Newton's) while normal running versus using the device 30. These are indicated as force A at the hip and femur Joint reaction force 98 in the X, Y, and Z directions or plane; force B at the knee and tibia Joint reaction force 98 in the X, Y, and Z directions or plane; and force C at the tibia and talus at ankle Joint reaction force 98 in the X, Y, and Z directions or plane. The peak joint forces are reported according to the direction in which they act in the X-Y-Z coordinate system shown above. All peak joint forces on the device 30 are less than those experienced while normal running. The only joint force that is not substantially lower than that experienced while running is the force of the ankle (tibia) on the talus in the Y direction. This is likely due to this joint absorbing most of the weight placed on each foot. That said, these results indicate that the device does, in fact, preserve muscle forces while minimizing the loads experienced by the joints. Similarly to the muscle forces, all of the joint forces may be tuned by adjusting the weight on each foot since the joint forces are a result of the muscle forces pulling across the joints and the external forces on the body.

The details mentioned here are exemplary and not limiting. Other specific components and manners specific to describing the VARRI—A Vertical Running Machine 30 may be added by a person having ordinary skill in the field of exercise, running and rehabilitation devices and systems and still be within the scope and spirit of this disclosed device 30.

Operation of the Preferred Embodiment

The VARRI—A Vertical Running Machine 30—has been described in the above embodiment. The manner of how the device operates is described below. One notes well that the description above and the operation described here must be taken together to fully illustrate the concept of the Vertical Running Machine 30. The preferred embodiment is the vertical running machine 30 comprised of: a) a structure framework 59, 60, 62, 64, 66 configured as a group of horizontal, vertical, diagonal and cantilevered tubes interconnected with a means to fasten the ends of each tube to the adjoining tube; b) a movable seat 49 for a user 100, the seat having a movable back 50 and a group of vertical structural members 53 affixed to the framework at one end and the seat 49 at the opposite end; c) a group of pulleys 51 affixed by a means 52 for removably securing each of the pulley to the structure framework; d) a pair of cables 55 with opposite ends, each cable with a first end removably secured by a means 47 for securing the cable to one of a pair of foot harnesses 41 and each cable 55 at an opposite end removably affixed to a means (winch 43 or hydraulic unit 44) for tensioning and pulling by a means for securing the cable 55, whereby the means for tensioning and pulling can then controllably cycle and release each foot harness 41; e) a programmable computer 70 for engaging the means 43, 44 for tensioning and pulling and for controllably releasing the tension, and the programmable computer 70 for controlling a weight applied, for controlling a speed of cycling the tensioning and release, and for controlling a length/stride of the movement; f) a pair of controller sticks 73 and/or a set of buttons near the user and attached to the seat as a means to control the computer/controller 70; g) a means 76 for powering the computer/controller; and h) a control and power cable 75 to interconnect the means for powering 76 (power source), computer 70 and controls 73 at the seat 49 wherein the vertical running machine 30 removes the effect of gravity on the joints and bones while running without impact.

One of the main concepts of this innovation is to remove the effects of gravity on the joints and bones of the body while duplicating the act of running. This is accomplished by a mechanical designed device 30, as referenced in the illustrations. The user sits 100 down on an automatic reclining chair 49 and steps into the foot attachments 41. The user 100 or the operator presses the first button (on controls 73) connected to the the computer 70 (by control line 75) which activates the electronic weight resistance system, or the pneumatic free weight system 45, which also adjusts the foot attachment 41 to the size of the user 100 and simultaneously converts the chair 49, 50 into a horizontal platform (lowers the back 50) while raising the legs into vertical running position (i.e. horizontal and essentially parallel to the floor). The user 100, or the operator presses the second button (on controls 73) on the computer 70 which selects or enters the program to accommodate the physical dimensions or conditions of the user 100 and activates or enters the prescribed program for that specific user.

The parts and component were shown in FIG. 3A as a VARRI—A Vertical Running Machine 30; a pair of feet harnesses 41 and means for securing the feet of a user to the cable system of the Vertical Running Machine 30; a stride adjustment button 42; a winch mechanism 43; a hydraulic mechanism 44; a group of resistance weights 45; an adjustment knob 46; a means 47 for connecting cable 55 to another cable, structure or weights; a chair 49; a chair back 50; a pulley 51, wheel, gear, or the like; a means 52 for securing pulley 51 to structure; a group of vertical supports 53 for chair 49; a cable 55, rope, cord or the like; a support structures 59; a vertical tubing 60 or structure; a horizontal base tubing 62 or structure; a horizontal tubing 64 or structure; a horizontal cross support 65; a horizontal cantilevered tubing 66 or structure; a controller or computer 70; a set of hand controls 73 at seat 49; a control and electrical wiring 75 from buttons to computer control 70; and a power source and plug-in 76. The operation of this device 30 is described below in the operation section.

The problem with normal running is that the joints, as well as bones, experience internal loads as a result of the body's mass and the resulting reaction forces from impact with the ground. This can lead to joint and bone damage after repetitive impacts over time or from a single excessive impact load. Furthermore, if the body's center of mass becomes unstable while running (i.e. falling), damage may occur in the ligaments or tendons due to stresses greater than the tissues can handle. This problem becomes especially significant in older people and people with previous musculoskeletal injuries. A solution must involve alleviating the loads on the joints and while maintaining the same loads on the muscles experienced during running. The loads experienced in the joints are a result of the impact of the body's mass with the ground. This impact is the result of the body's weight accelerating towards the ground, which is primarily due to gravity. Therefore, by removing the vertical effects of gravity on the joints, the internal loads in the joints will be highly reduced. The main concept of this innovation is to remove the effects of gravity on the joints and bones while maintaining the act of running. In order to do so, the device shown in FIG. 3A and FIGS. 2, 4, and 5 has been created. With this device, the user will experience the same effects of running, without the ground impact. A further explanation of how this simulated running in the VARRI device 30 is: this is accomplished by the user 100 running in a plane that is parallel to gravity (essentially horizontal to the floor). As a result, there is no internal joint loads do to impact with the ground. FIG. 3A shows a side profile of a person 100 who is using the device 30 and has their feet elevated. In order to start using the device, the user 100 places their feet in the feet harnesses 41, sits in the reclining chair 49, 50, and then presses the button 42 on the side of the chair. The back 50 of the seat 49 back is then laid down while the legs are simultaneously raised by the pulling mechanism (i.e. winch 43 or hydraulic unit 44). The mechanism for raising the legs is designed such that the weight of the legs is less than that of the minimum weight stack 45 so that the pulling mechanism raises only the legs. Additionally, the raise length height is adjustable according to the stride length of each user 100 and is controlled by simply pressing the button 42. The user 100 is now fully engaged with the device 30 and may begin running. However, if he/she (the user) determines that he/she would like a larger amount of resistance, the user may adjust the resistance weight 45 by turning the knob 46 to a higher or lower weight selection. Furthermore, the weight change is accomplished while the user 100 has his/her legs raised in the neutral position. When the user has completed his/her run/session, he/she exits the device by simply pressing the button to lower their legs and raise the back 50 of the chair 49. Once their feet are on the ground and the chair back is completely raised, the user 100 simply just steps out of the feet harnesses 41.

Additionally, the muscle activity has been included in FIG. 6. In this image, the runner's right leg is preparing to toe off while their left leg is preparing for initial contact. In contrast to normal ground running, propulsion and stabilization forces are generated by reaction forces between the foot and the weights. Identical to normal ground running, the anterior tibial, calf, hamstrings, and hip extensor muscles are all active in the right leg as the user pushes against the pull of gravity on the weight. Similarly, the left leg experiences the identical muscle forces to normal running as it prepares for initial contact. The anterior tibial, quad, rectus femoris, and calf are all working against the pull of the weight as the leg is being pulled upwards (compared with swinging forward for normal ground running). However, the main component of normal ground running that is missing from this image is the reaction forces due to the body's mass impacting the ground. This is because the user is working against a vertical force due to the weight stack. Therefore, since the user is lying parallel to the ground, the joints do not experience the vertical effects of gravity. Furthermore, the reaction loads due to the weight stack with be primarily focused on the muscles and connective tissue.

Uses and embodiments for the VARRI are now understood based on the description and operation provided in the preceding sections. One embodiment of the novel technology relates to the relationship of gravity and the functionality of the body in motion utilizing the bio-mechanical technology designed within the scope of the invention. Another embodiment provides a method and means of creating a unique anti-gravity running device, affording a non-impact rehabilitation and training system eliminating gravitational impact on the body's joints and bones. A further embodiment incorporates the VARRI as applied to Physical Therapy procedures in the field of health and fitness and in reference to a safer and faster methodology of recovery from surgery and athletic injuries without impact and stress. A still other use of this invention is as a designed device that can be adaptable to the bedridden patients in hospital beds following the same functionality guidelines for rehabilitation of the sick and elderly who cannot bear weight on their skeletal muscle groups. Another important function of the VARRI focuses on the prevention of injuries by strengthening the hamstrings and quadriceps as well as increasing the ability of the tendons and ligaments of the knee joint. These are the protective tissues that keep the bones in place and prevents them from grinding against each other. By training on this non-impact and gravity free apparatus, injuries can be reduced by eliminating stress on the skeletal muscles as illustrated in the Muscle Forces and Joint Reaction Forces as proven on the Charts accompanying this application and disclosure. Another use of the VARRI is as an apparatus which is designed specifically to train the body's muscle fibers in such a manner as to make a change in the fiber constituents. This change is accomplished without impact, deviation, or compromise of other affiliated body parts. This is especially focused on the users desire to change the muscular fibers in order to rehabilitate or maximize his or her own potential in any desired field of health and fitness or athletic performance.

With this description it is to be understood that the VARRI—Vertical Running Machine 30 is not to be limited to only the disclosed embodiment of product. The features of the VARRI 30 are intended to cover various modifications and equivalent arrangements included within the spirit and scope of the description.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

The present invention contemplates modifications as would occur to those skilled in the art. While the disclosure has been illustrated and described in detail in the figures and the foregoing description, the same is to be considered as illustrative and not restrictive in character, it being understood that only selected embodiments have been shown and described and that all changes, modifications and equivalents that come within the spirit of the disclosures described heretofore and or/defined by the following claims are desired to be protected.

What is claimed is:

1. An anti-gravity running machine operated solely by the legs of a user whereby the anti-gravity running machine removes the effects of gravity and repetitive impact to a ground/surface from running on the user's joints and bones while exercising without impact and wherein the anti-gravity running machine consists of:

a) a structural framework made of durable materials and configured as a group of horizontal, adjustable and telescoping vertical, diagonal, and cantilevered tubes, each tube having opposite ends, and the ends are interconnected with a means for fastening the ends of each tube to an adjoining tube;

b) a movable seat mounted on a slide base structure (48) for the user, the movable seat having a reclinable back and a group of vertical structural members affixed to the framework at one end and the movable seat at an opposite end, the movable seat allowing the user to recline horizontally at the waist and to use the legs of the user in a running motion without the effects of vertical impact and gravity which results in biomechanics that allow the user to compare the effects of gravity and vertical impact to a set of multiple muscles and joints;

c) a group of pulleys affixed in paired sets by a means for removably securing each of the pulleys to the structure framework;

d) a pair of cables guided by the paired sets of pulleys, the cables with opposite ends, each cable with a first end removably secured by a means for securing the cable to one of a pair of foot harnesses and each cable at an opposite end removably affixed to a pair of a set of weights that are manually adjusted as a means for tensioning and pulling the secured cable, whereby the means for tensioning and pulling each secured cable by the user thereby controllably and alternatively cycles and releases each foot harness and leg and whereby each of the pair of the set of weights resists the leg action of the user and offsets the weight of the leg of the user during the alternative cycles thereby resulting in repetitive motions which removes the effects of gravity and the effects of repetitive impact to the ground/surface of running on a group of muscles and joints of the user and which improves the user's leg strength, increases the user's stride and increases the user's speed; and e) a pair of hand grips to aid the balance of the user while reclining wherein the leg-powered, anti-gravity running machine with the reclined movable seat, paired cables, and paired resisting set of weights off-sets the weight of the user's legs and provides additional resistance during a series of performance training programs, wherein the running machine eliminates the effect of repetitive impact of running on the ground/surface to the group of the joints and bones of the user, and wherein the running machine is utilized for both rehabilitation and performance conditioning of athletes.

2. A leg powered, anti-gravity running machine that removes the effect of gravity and repetitive impact to a ground/surface from running on a user's joints and bones while exercising without impact wherein the anti-gravity running machine consists of:

a) a structural framework made of a powder-coated steel tube material and configured as a group of horizontal, adjustable and telescoping vertical, diagonal, and cantilevered tubes, each tube having opposite ends, and the ends are interconnected with a means for fastening the ends of each tube to an adjoining tube;

b) a movable seat mounted on a slide base structure (48) for the user positioned in front of the framework and a group of vertical structural members affixed to the framework at one end near the user's leg, the movable seat allowing the user to recline at the waist horizontally and to use the legs of the user in a running motion without the effects of vertical impact and gravity which results in biomechanics that allow the user to compare the effects of gravity and vertical impact to a set of multiple muscles and joints, and the movable seat positioned at an end opposite of the one end, wherein the legs of the user are positioned between the framework and the movable seat, and wherein the movable seat has a reclinable back;

c) a group of pulleys affixed in paired sets by a means for removably securing each of the pulley to the structure framework;

d) a pair of cables guided by the paired sets of pulleys, the cables with opposite ends, each cable with a first end removably secured by a means for securing the cable to one of a pair of foot harnesses and each cable at an opposite end removably affixed to a pair of a set of weights that are manually adjusted as a means for tensioning and pulling the secured cable, whereby the means for tensioning and pulling each secured cable by the user thereby controllably and alternatively cycles and releases each foot harness and whereby each of the pair of the set of weights resists the leg action of the user and offsets the weight of the leg of the user during the alternative cycles thereby resulting in repetitive motions which removes the effects of gravity and the effects of vertical impact of running on the set of muscles and joints of the user; and e) a manual means for engaging the means for tensioning and pulling and for controllably releasing the tension and for controlling the set of weights applied and for controlling a speed of cycling the tensioning and release wherein the leg-powered, anti-gravity running machine with the reclined movable seat, paired cables, and paired resisting set of weights off-sets the weight of the user's legs and provides additional resistance during a series of performance training programs, wherein the running machine eliminates the effect of repetitive impact of running on the ground/surface to the group of the joints and bones of the user, and wherein the running machine is utilized for both rehabilitation and performance conditioning of athletes.

3. A leg powered, anti-gravity running machine that removes the effect of vertical impact to a ground/horizontal surface and gravity on a user's joints and bones wherein the leg powered, anti-gravity running machine consists of:

a) a structural framework supporting a group of components of the leg powered, anti-gravity running machine wherein the structural framework is made of durable materials and is configured as a group of horizontal, adjustable and telescoping vertical, diagonal, and cantilevered tubes, each tube having opposite ends, and the ends are interconnected with a means for fastening the ends of each tube to an adjoining tube;

b) a pair of cables guided to each of the user's legs by a paired set of pulleys, the cables with opposite ends, each cable with a first end removably secured by a means for securing the cable to one of a pair of foot harnesses and each cable at an opposite end removably affixed to a pair of a set of weights that are manually adjusted, the weights operating as a means for tensioning and pulling the secured cable, whereby the means for tensioning and pulling each secured cable by the user thereby controllably and alternatively cycles and releases each foot harness and leg and whereby each of the pair of the set of weights resists the leg action of the user and offsets the weight of the leg of the user during the alternative cycles thereby resulting in repetitive motions which removes the effects of gravity and the effects of vertical impact of running on a group of muscles and joints of the user and which improves the user's leg strength, increases the user's stride and increases the user's speed;

c) the group of pulleys affixed in paired sets by a means for removably securing each of the pulleys to the structural framework;

d) a movable seat mounted on a slide base structure (48) for the user, the movable seat having a reclinable back and a group of vertical structural members affixed to the framework at one end and the movable seat at an opposite end, the movable seat allowing the user to recline horizontally at the waist and to use the legs of the user in a running motion without the effects of vertical impact from ground and of gravity which results in biomechanics that allow the user to compare the effects of gravity and vertical impact to a set of multiple muscles and joints; and e) a pair of hand grips, one of the grips on each side of the movable seat and secured to the structural framework, wherein the pair of hand grips aid the balance of the user while the user is in a reclining position wherein the leg-powered, anti-gravity running machine with the reclined movable seat, paired cables, and paired resisting set of weights off-sets the weight of the user's legs and provides additional resistance during a series of performance training programs, wherein the running machine eliminates the effect of repetitive impact of running on the ground/surface to the group of the joints and bones of the user, and wherein the running machine is utilized for both rehabilitation and performance conditioning of athletes.

4. The leg powered, anti-gravity running machine according to claim 3 wherein the structural framework is selected from a group consisting of those with cross sections of a structural channel, a wide flange W beam, a standard I beam, a Tee beam, a square, a rectangle, a round tube, a pipe, and an angle.

5. The leg powered, anti-gravity running machine according to claim 3 wherein the durable material of the framework is selected from a group consisting of steel, steel alloy, stainless steel, aluminum, plastics, and composite materials.

6. The leg powered, anti-gravity running machine according to claim 3 wherein the means for fastening the ends of the tubes of the structural framework are selected from a group consisting of threaded fasteners, rivets, rods and cotter keys, and rods with spring balls at an end.

7. The leg powered, anti-gravity running machine according to claim 3 wherein the means for securing the cable to one of the pair of foot harnesses is selected from a group consisting of a step in half-shoe foot harness (41A), a step in full width heel shoe (41B), and a step in self-tightening loops (41C).

8. The leg powered, anti-gravity running machine device according to claim 3 wherein results of repeated cycles, in an inclined position of the movable seat without gravity or impact, demonstrate and track utilization and effects on a group of muscles by a user with a plotted distribution throughout a group of muscles comparing peak forces resulting from a person running versus from a person using the machine ensures mechanical stability of the device in impacting the group of muscles as demonstrated on the charts and enhancing muscle peak force selected from a group consisting of a Soleus Muscle peak force of pressure registered as approximately 2,880 Newton units while running on the ground and an approximately 453 units of pressure while running on the device; a Gluteus Medius peak force of pressure registered as approximately 1,152 Newton units while running on the ground and an approximately 462 units of pressure while running on the device; a Medial Gast peak force of pressure registered as approximately 1,395 Newton units while running on the ground and an approximately 1,135 units of pressure while running on the device; a Rectus Femoris peak force of pressure registered as approximately 966 Newton units while running on the ground and an approximately 905 units of pressure while running on the device; a Gluteus Max 2 peak force of pressure registered as approximately 723 Newton units while running on the ground and an approximately 142 units of pressure while running on the device; an Anterior Tibialis peak force of pressure registered as approximately 584 Newton units while running on the ground an approximately 235 units of pressure while running on the device; a Biceps Femoris short head peak force of pressure registered as approximately 548 Newton units while running on the ground and an approximately 516 units of pressure while running on the device; a Gluteus Max 1 peak force of pressure registered as approximately 475 Newton units while running on the ground and an approximately 55 units of pressure while running on the device; a Lateral Gast peak force of pressure registered as approximately 488 Newton units while running on the ground and an approximately 238 units of pressure while running on the device; a Gluteus Max 1 peak force of pressure registered as approximately 475 Newton units while running on the ground and an approximately 55 units of pressure while running on the device; and a Gluteus Max 3 peak force of pressure registered as approximately 461 Newton units while running on the ground and an approximately 89 units of pressure while running on the device.

9. The leg powered, anti-gravity running machine device according to claim 3 wherein results of repeated cycles, in an inclined position of the movable seat without gravity or impact, demonstrate and track utilization and effects on a group of joints by a user with a plotted distribution throughout a group of joints comparing peak forces resulting from a person running versus from a person using the machine ensures mechanical stability of the device in impacting the group of joints as demonstrated on the charts and enhancing joint reaction peak force selected from a group consisting of a Hip on Femur(Y) peak is registered as an approximately 111,000 while running on the ground and an approximately 800 units of pressure while running on the device; a Knee on Tibia(Y) peak is registered as an approximately 100,000 while running on the ground and an approximately 330 units of pressure while running on the device; an Ankle or Talus(Y) peak is registered as an approximately 4,000 while running on the ground and an approximately 320 units of pressure while running on the device; a Hip on Femur(X) peak is registered as an approximately 80,000 while running on the ground and an approximately 2,200 units of pressure while running on the device; a Knee on Tibia(X) peak is registered as an approximately 65,000 while running on the ground and an approximately 1,200 units of pressure while running on the device; an Ankle on Talus(X) peak is registered as an approximately 5,900 while running on the ground and an approximately 3,700 units of pressure while running on the device; a Hip on Femur(Z) peak is registered as an approximately 20,000 running on the ground and an approximately 500 units of pressure while running on the device; a Knee on Tibia(Z) peak is registered as an approximately 10,000 while running on the ground and an approximately 120 units of pressure while running on the device; and an Tibia/Ankle on Talus(Z) peak is registered as an approximately 1,800 while running on the ground and an approximately 150 units of pressure while running on the device.

* * * * *